US006535191B1

(12) United States Patent
Miyachi

(10) Patent No.: US 6,535,191 B1
(45) Date of Patent: Mar. 18, 2003

(54) LIQUID CRYSTAL DISPLAY DEVICE

(75) Inventor: Koichi Miyachi, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/524,333

(22) Filed: Mar. 13, 2000

(30) Foreign Application Priority Data

Mar. 29, 1999 (JP) ..... 11-087283

(51) Int. Cl.[7] ..... G09G 3/36
(52) U.S. Cl. ..... 345/94; 345/89; 345/97
(58) Field of Search ..... 345/87, 94, 95, 345/96, 99, 208, 210, 89, 97

(56) References Cited

U.S. PATENT DOCUMENTS

| | | | | | |
|---|---|---|---|---|---|
| 3,677,261 | A | * | 7/1972 | Day | 327/1 |
| 4,711,531 | A | * | 12/1987 | Masubuchi | 345/97 |
| 5,040,874 | A | * | 8/1991 | Fukuda | 345/87 |
| 5,724,112 | A | * | 3/1998 | Yoshida et al. | 349/114 |
| 5,724,116 | A | * | 3/1998 | Suzuki | 349/130 |
| 5,731,794 | A | * | 3/1998 | Miyazawa | 345/102 |
| 5,923,310 | A | * | 7/1999 | Kim | 345/90 |
| 5,977,942 | A | * | 11/1999 | Walker et al. | 345/102 |
| 6,313,818 | B1 | * | 11/2001 | Kondo et al. | 345/89 |

FOREIGN PATENT DOCUMENTS

| | | |
|---|---|---|
| JP | 6-18854 | 1/1994 |
| JP | 8-50278 | 2/1996 |

OTHER PUBLICATIONS

Noel A. Clark, et al., "Applied Physics Letters", vol. 36, No. 11, pp. 899–901 (1980).

* cited by examiner

*Primary Examiner*—Kent Chang
(74) *Attorney, Agent, or Firm*—Dike, Bronstein, Roberts & Cushman IP Group Edwards & Angell, LLP; David G. Conlin; David A. Tucker

(57) ABSTRACT

A liquid crystal display device of the present invention includes: a main substrate having a main electrode; a counter substrate having a counter electrode; a liquid crystal material interposed between the main substrate and the counter substrate; and a control section for controlling a response start time of the liquid crystal material by a potential difference between a main electrode voltage that is applied to the main electrode during one frame and a counter electrode voltage that changes in a substantially continuous manner during the one frame, and for changing a transmissivity of the liquid crystal display device based on a magnitude of the main electrode voltage.

46 Claims, 18 Drawing Sheets

LIQUID CRYSTAL DISPLAY DEVICE

BACKGROUND OF THE INVENTION

1. Field of the Invention

The present invention relates to a liquid crystal display device capable of displaying gray scale images.

2. Description of the Related Art

A display principle using a ferroelectric liquid crystal device is proposed by N. A. Clark, et al. (See "Applied Physics Letters" Vol. 36, No. 11 (published on Jun. 1, 1980), Japanese Laid-Open Publication No. 56-107216, U.S. Pat. Nos. 4,367,924, and 4,563,059.) The ferroelectric liquid crystal device is a device in which the ferroelectric liquid crystal material is sealed into an extremely thin cell. A display mode using the ferroelectric liquid crystal device is generally referred to as Surface Stabilized Ferroelectric Liquid Crystal (SSFLC) mode. This display principle provides a significantly quick response property, e.g., tens of microseconds, and a wide angle of view. Thus, various researches and developments have been carried out on the SSFLC mode.

The SSFLC mode as described above is only capable of displaying black/white two-tone images, i.e., incapable of displaying gray scale images. In order to address such a drawback, various improvements have been made. Two typical examples among the improvements, the area-division gray scale driving method (see, for example, Japanese Laid-Open Publication No. 8-50278) and the time-division gray scale driving method (see, for example, Japanese Laid-Open Publication No. 6-18854), will be described.

The area-division gray scale driving method is performed such that a single pixel is divided into a plurality of subpixels, and the plurality of subpixels are driven separately.

As one of the simplest examples, consider the case where a single pixel is divided into two subpixels. In this case, it is possible to drive the first and second subpixels separately. Based on the combination of the on/off states of the two subpixels, the brightness of an image can be expressed in four gray levels, i.e., 0, 1, 2, and 3. Thus, the combination of the plurality of subpixels realizes display of gray scale images even in the SSFLC mode.

The time-division gray scale driving method is performed such that one frame (which is a minimum display period) is divided into a plurality of periods, and the plurality of periods are driven separately.

As one of the simplest examples, consider the case where one frame is divided into two periods (subframes). In this case, it is possible to drive the first period (first subframe) and the second period (second subframe) separately. Based on the combination of the first period and the second period, the brightness of an image can be expressed in four gray levels of 0, 1, 2, and 3. Thus, dividing one frame into a plurality of periods realizes display of gray scale images even in the SSFLC mode.

As a matter of course, the area-division gray scale driving method and the time-division gray scale driving method can be used in combination. For example, a pixel is driven with an area-division ratio (=1:the number of subpixels in a pixel) of 1:2 and with a time-division ratio (=1:the number of subframes in a frame) of 1:4:16:64, thereby achieving the display of images in 256 equally-divided gray levels.

The ferroelectric liquid crystal material, which itself is only capable of displaying two-tone images, can display gray scale images by using the area-division gray scale driving method or the time-division gray scale driving method.

However, in the area-division gray scale driving method and the time-division gray scale driving method as described above, the gray scales are digitized (quantitized) by nature, and the number of gray levels is thus limited. Therefore, the area-division gray scale driving method and the time-division gray scale driving method do not have a smooth gray scale property with respect to image signals. Furthermore, in the area-division gray scale driving method and the time-division gray scale driving method, adjustment of the image quality such as $\gamma$ correction cannot be performed. That is, a gray scale property of displayed images is limited by a predetermined area-division ratio and time-division ratio.

In the area-division gray scale driving method and the time-division gray scale driving method, one of the measures for increasing the number of gray levels is to increase the number of subpixels in a single pixel. This causes some disadvantages that a wiring structure and a pixel structure of the device become complicated, that an effective pixel area (numerical aperture) decreases, etc.

The number of gray levels also can be increased by increasing the time-division number. However, this is technically difficult to achieve because this causes an increase of the driving frequency and requires higher response speed for the liquid crystal material.

SUMMARY OF THE INVENTION

According to one aspect of the present invention, a liquid crystal display device includes: a main substrate having a main electrode; a counter substrate having a counter electrode; a liquid crystal material interposed between the main substrate and the counter substrate; and a control section for controlling a response start time of the liquid crystal material by a potential difference between a main electrode voltage that is applied to the main electrode during one frame and a counter electrode voltage that changes in a substantially continuous manner during the one frame, and for changing a transmissivity of the liquid crystal display device based on a magnitude of the main electrode voltage.

In one embodiment of the present invention, the control section changes the transmissivity of the liquid crystal display device by changing a direct-current voltage component of the main electrode voltage that is applied to the main electrode.

In another embodiment of the present invention, the control section changes the transmissivity of the liquid crystal display device by changing a direct-current voltage component of the counter electrode voltage that is applied to the counter electrode.

In still another embodiment of the present invention, the control section changes the transmissivity of the liquid crystal display device by changing a slope angle of a waveform of the counter electrode voltage with respect to the passage of time.

According to another aspect of the present invention, a liquid crystal display device includes: a TFT substrate having thin film transistors arranged in a matrix; a counter substrate having a transparent electrode; a liquid crystal material interposed between the TFT substrate and the counter substrate; and a control section for applying a voltage that changes in a substantially continuous manner to a storage capacitor line during a period within one frame, thereby writing a drain voltage in a drain electrode during the one frame, wherein a response start time of the liquid crystal material is determined by a magnitude of the drain voltage, and a transmissivity of the liquid crystal display device is determined by a potential difference between a potential of the storage capacitor line and a potential of the drain electrode.

In one embodiment of the present invention, the storage capacitor line is connected to a power supply which can be controlled independently of the power supply for applying the voltage to the counter substrate.

In another embodiment of the present invention, an odd-numbered line storage capacitor line to be connected to pixels of odd-numbered lines is connected to a first power supply; an even-numbered line storage capacitor line to be connected to pixels of even-numbered lines is connected to a second power supply: and the first power supply is different from the second power supply.

In still another embodiment of the present invention, the one frame includes a period during which a voltage for resetting an orientation of the liquid crystal material to the initial state is applied to the storage capacitor line.

In still another embodiment of the present invention, the control section applies the voltage for resetting the orientation of the liquid crystal material to the initial state to the liquid crystal material through a source line during the one frame.

In still another embodiment of the present invention, the one frame includes a period during which at least one of the voltage to be applied to the counter electrode and the voltage to be applied to the main electrode resets the orientation of the liquid crystal material to the initial state.

In still another embodiment of the present invention, during the one frame, after a signal has been written in the thin film transistor element, the voltage that changes in a substantially continuous manner is applied to the storage capacitor line.

In still another embodiment of the present invention, the one frame includes a period during which a signal is written in the thin film transistor element, a period during which a voltage to be applied to the storage capacitor line changes in a substantially continuous manner, and a period during which the orientation of the liquid crystal material is reset to the initial state.

According to still another aspect of the present invention, a liquid crystal display device includes: a main substrate having a main electrode; a counter substrate having a counter electrode; a liquid crystal material interposed between the main substrate and the counter substrate; and a control section for applying a voltage that changes in a substantially continuous manner to the liquid crystal material for a predetermined period within one frame, wherein a response start time of the liquid crystal material and a transmissivity of the liquid crystal display device are changed by changing an amplitude of the voltage.

According to still another aspect of the present invention, a liquid crystal display device includes: a TFT substrate having thin film transistors arranged in a matrix; a counter substrate having a transparent electrode; a liquid crystal material interposed between the TFT substrate and the counter substrate; an element having a resistance value that changes in accordance with a voltage applied to a memory capacitor of a pixel; and a control section for applying a voltage that changes in a substantially continuous manner to the element during a period within one frame, wherein the liquid crystal material is connected in series to the element, and a response start time of the liquid crystal material and a transmissivity of the liquid crystal display device are changed by changing an amplitude of the voltage that changes in a substantially continuous manner.

In one embodiment of the present invention, the control section includes a first power supply for applying a voltage to the liquid crystal display material through an odd-numbered line and a second power supply for applying a voltage to the liquid crystal display material through an even-numbered line; and the first power supply is different from the second power supply.

In another embodiment of the present invention, the one frame includes a period during which a voltage for resetting an orientation of the liquid crystal material to an initial state is applied to the liquid crystal material.

In still another embodiment of the present invention, the one frame includes a period during which a voltage for resetting an orientation of the liquid crystal material to an initial state is applied to the element.

In still another embodiment of the present invention, the control section applies a voltage for resetting to an initial state an orientation of the liquid crystal material to the liquid crystal material through a source line.

In still another embodiment of the present invention, during the one frame, after a signal has been written in the thin film transistor element, the voltage that changes in a substantially continuous manner is applied to the element.

In still another embodiment of the present invention, the one frame includes a first period during which a signal is written in the thin film transistor element, a second period during which a voltage to be applied to the element changes in a substantially continuous manner, and a third period during which the orientation of the liquid crystal material is reset to the initial state.

In still another embodiment of the present invention, the liquid crystal material is a ferroelectric liquid crystal material.

In still another embodiment of the present invention, the liquid crystal material is an antiferroelectric liquid crystal material.

In still another embodiment of the present invention, the liquid crystal material has a liquid crystal mode including two or more stable states.

In still another embodiment of the present invention, the liquid crystal display device includes a light source which is off for a predetermined period within the one frame.

In still another embodiment of the present invention, the liquid crystal display device includes a red light source, a green light source, and a blue light source, and field serial color display is performed by sequentially switching from one to another among the light sources for each frame, whereby a single color image is obtained from a plurality of frames.

In still another embodiment of the present invention, the control section controls a waveform of a voltage to be applied to the storage capacitor line, thereby adjusting at least one of an adjustment property and an adjustment balance.

In still another embodiment of the present invention, the control section controls a waveform of a voltage to be applied to the liquid crystal material, thereby adjusting at least one of an adjustment property and an adjustment balance.

In still another embodiment of the present invention, the control section controls a waveform of a voltage to be applied to the element, thereby adjusting at least one of an adjustment property and an adjustment balance.

In still another embodiment of the present invention, the control section adjusts a source signal voltage to be written corresponding to a gray scale signal, thereby adjusting at least one of an adjustment property and an adjustment balance.

In still another embodiment of the present invention, the control section adjusts a source signal voltage that is to be written in the element and that corresponds to a gray scale signal, thereby adjusting at least one of an adjustment property and an adjustment balance.

Now, functions of the present invention will be described.

The liquid crystal display device of the present invention can display gray scale images by controlling the response start time of the liquid crystal material in an analog manner. A portion of a voltage to be applied to the liquid crystal material changes with the passage of time, thereby controlling the timing of reaching the threshold voltage at which the response of the liquid crystal material occurs.

Alternatively, the timing of reaching the threshold voltage at which the response of the liquid crystal material occurs is controlled by adjusting an amplitude of a voltage to be applied to the liquid crystal material, which includes components that changes with the passage of time.

Thus, the invention described herein makes possible the advantage of providing an analog-like gray scale property by changing the voltage even in the liquid crystal modes wherein it is difficult to perform an analog gray scale display, for example, a liquid crystal mode only capable of displaying two-tone images (such as a ferroelectric liquid crystal device, an antiferroelectric liquid crystal device, a cholesteric liquid crystal device having an appropriately adjusted orientation, a nematic liquid crystal device, etc.).

This and other advantages of the present invention will become apparent to those skilled in the art upon reading and understanding the following detailed description with reference to the accompanying figures.

DESCRIPTION OF THE PREFERRED EMBODIMENTS

Hereinafter, embodiments of the present invention will be described with reference to the attached drawings.

(Embodiment 1)

A liquid crystal display device according to embodiment 1 of the present invention will be described with reference to FIGS. 1 to 8.

Figure 1:
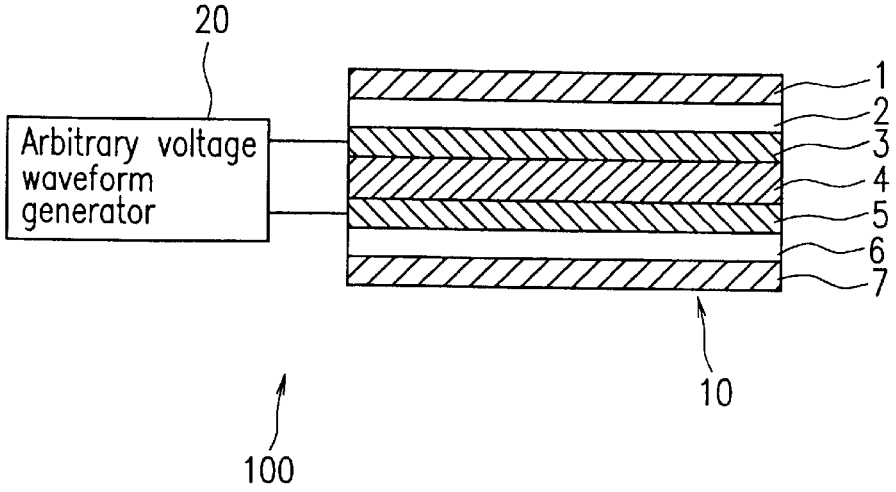
FIG. 1 shows a ferroelectric liquid crystal display device 100.

FIG. 1 shows a structure of a ferroelectric liquid crystal display device 100. The ferroelectric liquid crystal display device 100 includes a ferroelectric liquid crystal panel 10 and an arbitrary voltage waveform generator 20. The ferroelectric liquid crystal panel 10 includes polarizer 1 and 7, glass substrates 2 and 6, orientation films 3 and 5, and a ferroelectric liquid crystal material 4. In addition, between the glass substrates 2 and the orientation films 3 a counter electrode (not shown) is provided on the surface of the glass substrates (a counter substrates) 2, and between the glass substrates 6 and the orientation films 5 a main electrode (not shown) is provided on the surface of the glass substrates (a main substrates) 6.

A production method of the ferroelectric liquid crystal panel 10 is now briefly described.

An ITO film (not shown), which is a transparent electrode, is formed on the glass substrates 2 and 6 by a commonly-employed sputtering method. Polyimide is applied to the glass substrates 2 and 6 so as to form orientation films having a thickness of 0.1 $\mu$m, and the surface of the resultant film is rubbed with a soft cloth. Thereafter, spacer beads (not shown) having a particle size of 1.3 $\mu$m and being formed of plastic are sprayed on at least one of the rubbed glass substrates 2 and 6. The glass substrates 2 and 6 are then combined such that the orientation films of the glass substrates 2 and 6 face each other, and the rubbing directions of the glass substrates 2 and 6 are parallel to each other. When the glass substrates 2 and 6 are combined, an outer periphery of the glass substrates 2 and 6 are seal printed with an epoxy resin containing glass fibers having a diameter of 1.3 $\mu$m so as to leave a vacant space into which the liquid crystal material is injected. After the glass substrates 2 and 6 are combined, the resultant laminate is heated at 180° C., whereby the epoxy resin is cured.

Figure 2:
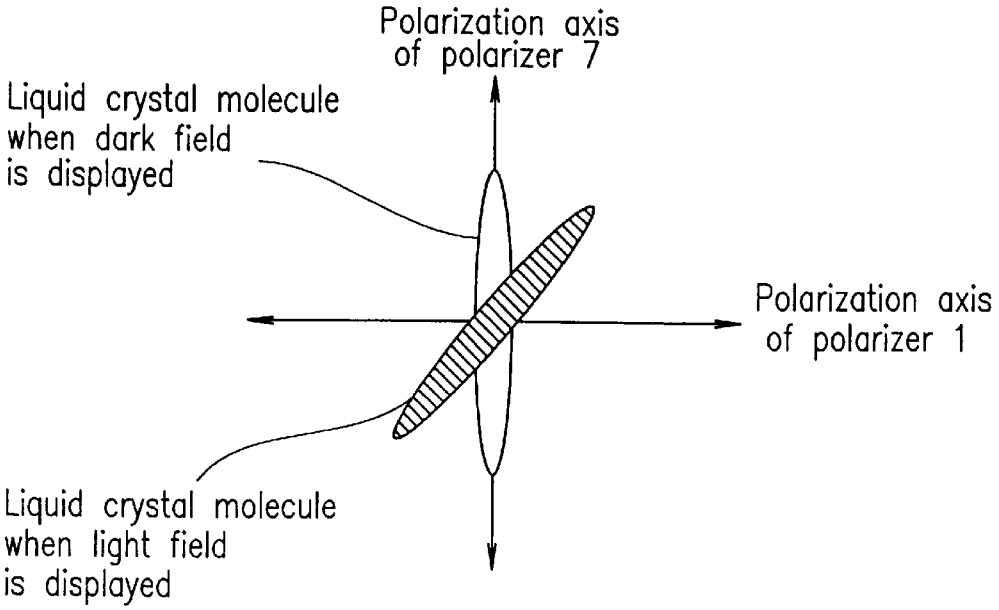
FIG. 2 shows a relationship between the polarization axes of polarizers 1 and 7 and the polarization axis of a ferroelectric liquid crystal material 4.

The ferroelectric liquid crystal material is injected into the thus fabricated panel, and polarizers 1 and 7 are provided on the surfaces of the ferroelectric liquid crystal panel 10, i.e., on the glass substrates 2 and 6, respectively, such that the polarization axis of the polarizer 1 is orthogonal to that of the polarizer 7. The polarization axes of the polarizers 1 and 7 are adjusted such that the ferroelectric liquid crystal panel 10 displays a dark field when a voltage having a predetermined polarity is applied to the ferroelectric liquid crystal material 4. Thus, when a voltage having an opposite polarity to the predetermined polarity is applied to the ferroelectric liquid crystal material 4, the ferroelectric liquid crystal panel 10 displays a light field. FIG. 2 shows a relationship between the polarization axes of the polarizers 1 and 7 and the polarization axis of the ferroelectric liquid crystal material 4.

Figure 3:
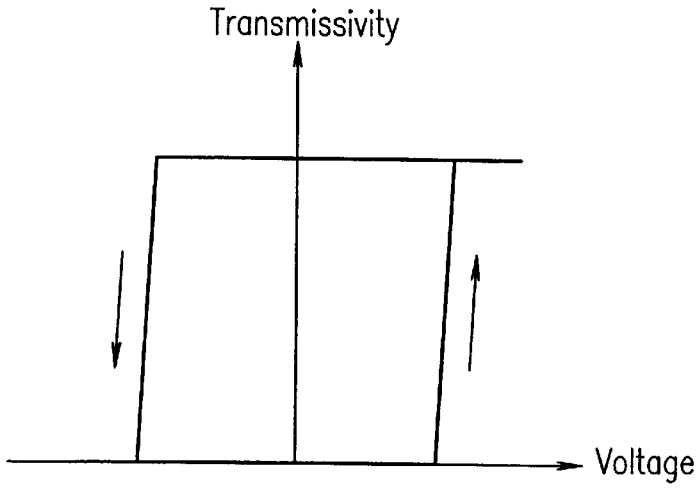
FIG. 3 shows a relationship between a voltage having a deformed saw-tooth waveform and the transmissivity of a ferroelectric liquid crystal panel 10 when the deformed saw-tooth waveform voltage of 1 Hz is applied to the ferroelectric liquid crystal panel 10.

FIG. 3 shows a relationship between a voltage having a deformed saw-tooth waveform and the transmissivity of a ferroelectric liquid crystal panel 10 when the deformed saw-tooth waveform voltage of 1 Hz is applied to the ferroelectric liquid crystal panel 10. A property shown in FIG. 3 is a well-known hysteresis property of the ferroelectric liquid crystal material. That is, the ferroelectric liquid crystal panel 10 is only capable of displaying images with a two-level gray scale because the ferroelectric liquid crystal material has a quick-responsive threshold property.

Figure 4:
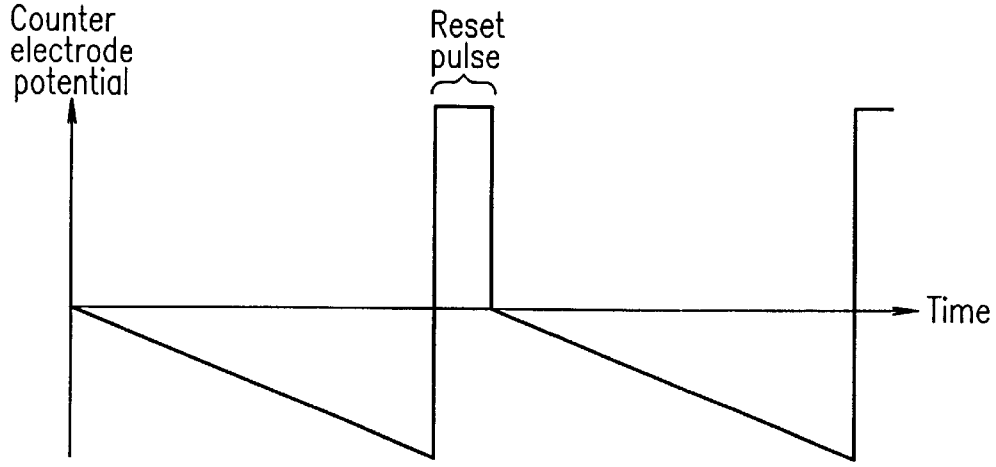
FIG. 4 shows a deformed saw-tooth waveform voltage of about 60 Hz which is applied to a counter electrode of the ferroelectric liquid crystal panel 10.
Figure 5:
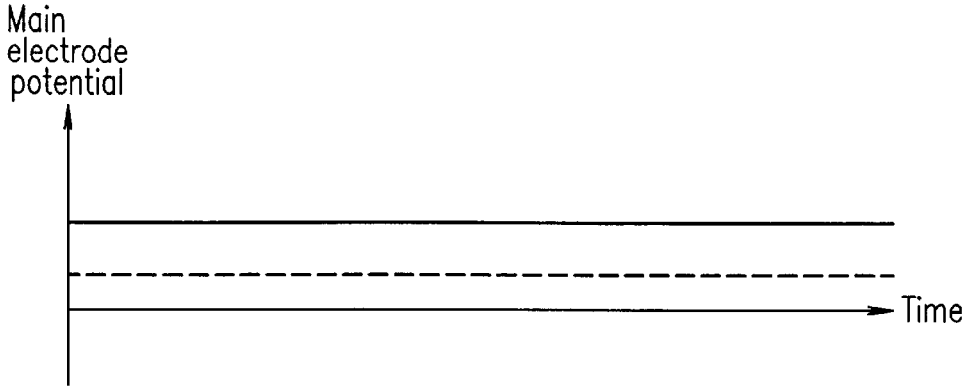
FIG. 5 shows a DC voltage which is applied to a main electrode of the ferroelectric liquid crystal panel 10.

FIG. 4 shows a deformed saw-tooth waveform voltage of about 60 Hz which is applied to a counter electrode of the ferroelectric liquid crystal panel 10. FIG. 5 shows a DC voltage which is applied to a main electrode of the ferroelectric liquid crystal panel 10. A solid line and a broken line indicate DC voltages having different values.

Figure 6:
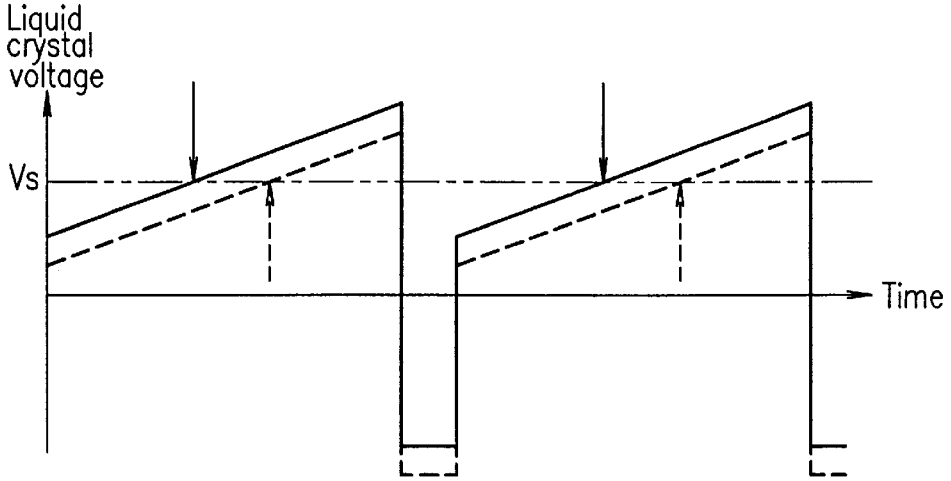
FIG. 6 shows a composite voltage of the deformed saw-tooth waveform voltage shown in FIG. 4 and the DC voltage shown in FIG. 5.

A voltage that is in fact applied to the ferroelectric liquid crystal material is a composite voltage of the deformed saw-tooth waveform voltage shown in FIG. 4 and the DC voltage shown in FIG. 5. FIG. 6 shows a composite voltage of the deformed saw-tooth waveform voltage shown in FIG. 4 and the DC voltage shown in FIG. 5. The deformed saw-tooth waveform voltage shown in FIG. 4 and the DC voltage shown in FIG. 5 are generated by an arbitrary voltage waveform generator 20 shown in FIG. 1.

Since a response characteristic to the voltage which is applied to the ferroelectric liquid crystal material gives the distinctive threshold property as shown in FIG. 3, the response timing of the ferroelectric liquid crystal material is different between the waveforms indicated by the solid line and the broken line of FIG. 6. In FIG. 6, arrows indicate points at which the waveforms of the solid line and the broken line are at threshold voltage Vs for the ferroelectric liquid crystal material.

As shown in FIG. 4, a waveform of the voltage which is applied to the counter electrode includes a pulse waveform for resetting the ferroelectric liquid crystal material which responded to the threshold voltage Vs to the initial state before the material responded to the applied voltage Vs. For convenience, this pulse waveform is hereinafter referred to as a reset pulse. The reset pulse is adjusted to a pulse height such that, in response to the application of DC voltage to the main electrode, the reset pulse can reset the state of the ferroelectric liquid crystal material to a state before the material responded to the applied voltage as long as the applied DC voltage is in an appropriate voltage range.

Figure 7:
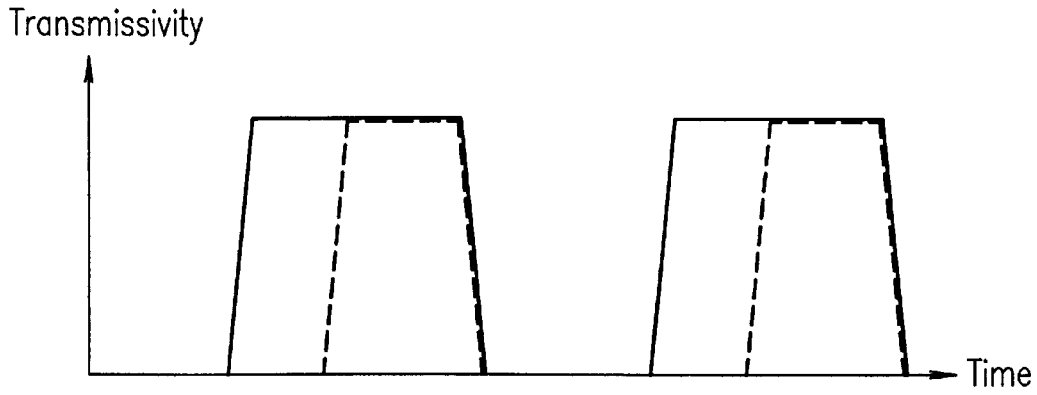
FIG. 7 shows a transition of the transmissivity of the ferroelectric liquid crystal panel 10 with the passage of time.

FIG. 7 shows how the transmissivity of the ferroelectric liquid crystal panel 10 changes with the passage of time under the above-described conditions.

As shown in FIG. 7, the response timing is different between the solid line and the broken line whereas the ferroelectric liquid crystal material is reset to the initial dark-state at the same timing for both the solid and broken lines. That is, the length of time in which the light-state is displayed is different between the solid line and the broken line. In the present embodiment, the ferroelectric liquid crystal panel 10 is driven at 60 Hz, and a light source (not shown) is provided under the ferroelectric liquid crystal panel 10. The human eye does not perceive that the ferroelectric liquid crystal panel 10 blinks at 60 Hz, but senses the quantity of light corresponding to an integral value of the transmissivity with respect to the time as a brightness. Thus, although the ferroelectric liquid crystal panel 10 provides a continuous brightness to the human eye for both the solid line and the broken line of FIG. 7, the brightness for the solid line looks greater for the human eye than that for the broken line.

Figure 8:
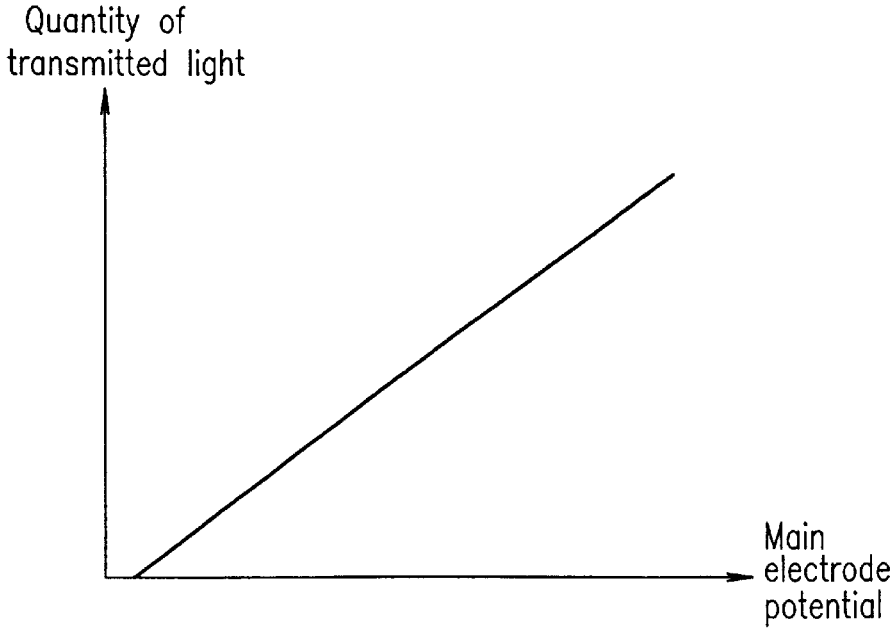
FIG. 8 shows a relationship between the DC voltage to be applied to the main electrode and the quantity of transmitted light perceived by the human eye.

FIG. 8. shows a relationship between the DC voltage that is applied to the main electrode (horizontal axis) and a quantity of transmitted light that is perceived by the human eye (vertical axis).

As shown in FIG. 8, the quantity of transmitted light increases very smoothly as the DC voltage that is applied to the main electrode increases. That is, even when the ferroelectric liquid crystal material is used, an analog gray scale can be obtained by controlling the DC voltage that is applied to the main electrode. Thus, by using a liquid crystal mode which has a quick-responsive threshold property with respect to the voltage, a liquid crystal display device (light valve) in which the analog gray scale is used for displaying is achieved by controlling the DC voltage that is applied to the main electrode.

In the present embodiment, the electrodes are referred to as a "main electrode" and a "counter electrode" for convenience. However, the liquid crystal display device of the present invention is symmetrical, and the same effect thus can be obtained if the waveforms of the voltage to be applied to the main electrode and the counter electrode are exchanged with each other.

Furthermore, a gray scale display also can be controlled by controlling the DC level of a waveform of a counter electrode voltage or by controlling the slope angle of the waveform of the counter electrode voltage that changes with the passage of time.

An antiferroelectric liquid crystal material having a three-state stability may be used instead of the ferroelectric liquid crystal material used in embodiment 1. With the antiferroelectric liquid crystal material, the analog gray scale can be obtained by controlling a DC voltage to be applied to the main electrode.

Even when a cholesteric liquid crystal material having a quick-responsive threshold property with respect to the voltage is used instead of the ferroelectric liquid crystal material used in embodiment 1, an analog gray scale liquid crystal display device can be driven by the driving method described in embodiment 1.

Alternatively, even when a nematic liquid crystal material having an orientation adjusted so as to have a quick-responsive threshold property (for example, a thin 180° twist cell) is used instead of the ferroelectric liquid crystal material used in embodiment 1, an analog gray scale liquid crystal display device can be driven by the driving method described in embodiment 1 because of the quick-responsive threshold property of the liquid crystal material with respect to the voltage.

(Embodiment 2)

A liquid crystal display device according to embodiment 2 of the present invention will be described with reference to FIGS. 9 to 12.

In embodiment 2, the method used in embodiment 1 is applied to the TFT driving method. That is, according to embodiment 2, an analog gray scale liquid crystal display device can be realized even with the ferroelectric liquid crystal material which can only provide a two-level gray scale display.

Figure 9:
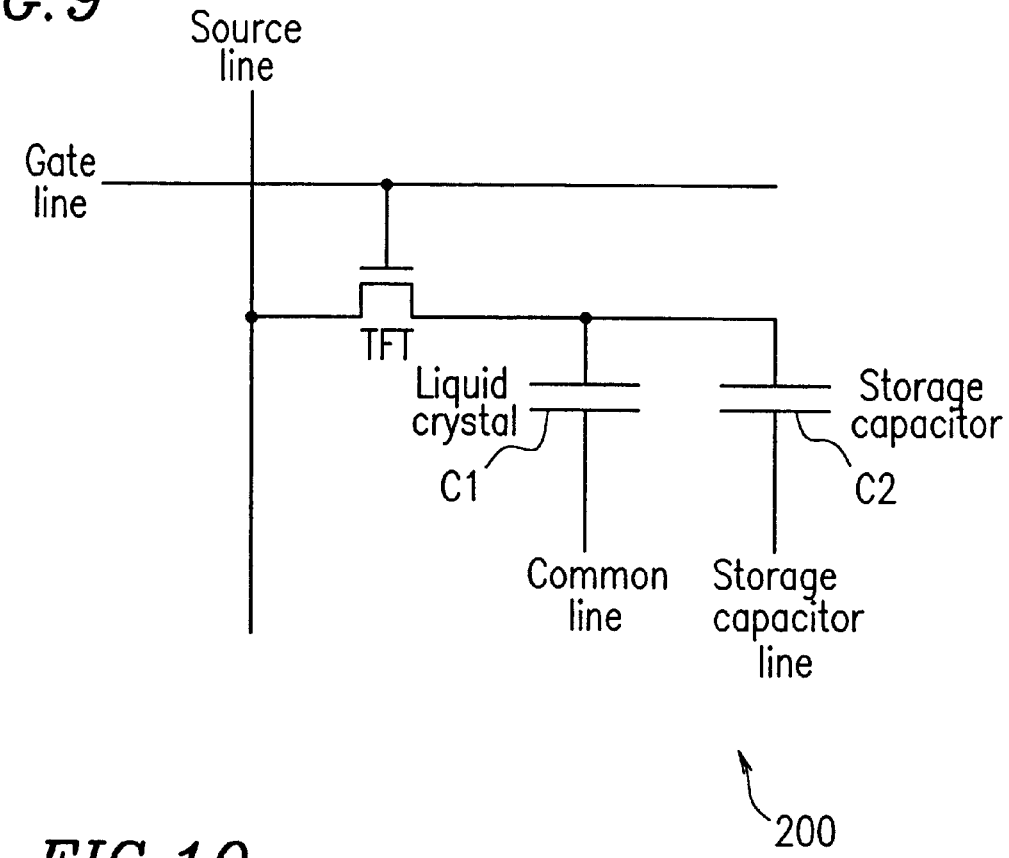
FIG. 9 shows a portion of an active matrix liquid crystal panel 200 according to embodiment 2 of the present invention.

FIG. 9 shows a portion of an active matrix liquid crystal panel 200 according to embodiment 2 of the present invention.

A TFT substrate of the active matrix liquid crystal panel 200 is the same as the typical TFT substrate as conventionally used, except for the connection of a storage capacitor line. In the conventional TFT substrate, the storage capacitor line is connected to a common line. However, in the TFT substrate of the active matrix liquid crystal panel 200, the storage capacitor line is not connected to a common line because the storage is capacitor line is connected to an independent power supply.

A counter substrate of the active matrix liquid crystal panel 200 is the same as the typical counter substrate as conventionally used. The ferroelectric liquid crystal material is injected between the TFT substrate and the counter substrate, and appropriately oriented, and the active matrix liquid crystal panel 200 is thus fabricated.

Now, an operation of embodiment 2 will be described in detail with reference to FIGS. 10–12.

Figure 10:
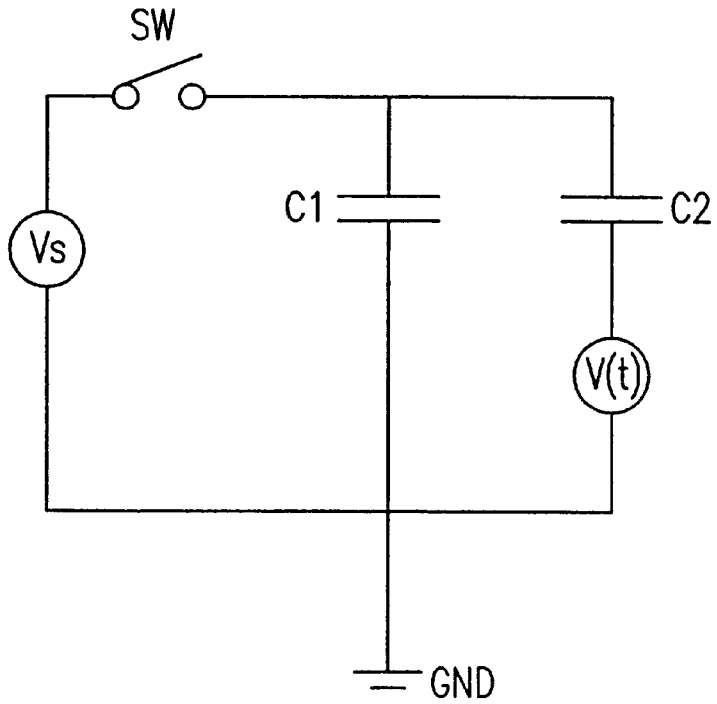
FIG. 10 shows an equivalent circuit of one of the pixels included in the active matrix liquid crystal panel 200.

FIG. 10 shows an equivalent circuit of one of pixels included in the active matrix liquid crystal panel 200.

A switch SW is a TFT element formed on a TFT substrate. Thus, the switch SW is ON only when a gate line is high whereas the switch SW is OFF when the gate line is low. A signal voltage denoted by a symbol Vs is applied to a liquid crystal capacitor C1 and a storage capacitor C2 only when the switch SW is ON. The storage capacitor C2 is connected to a power supply for supplying a voltage V(t) that changes with the passage of time.

Figure 11:
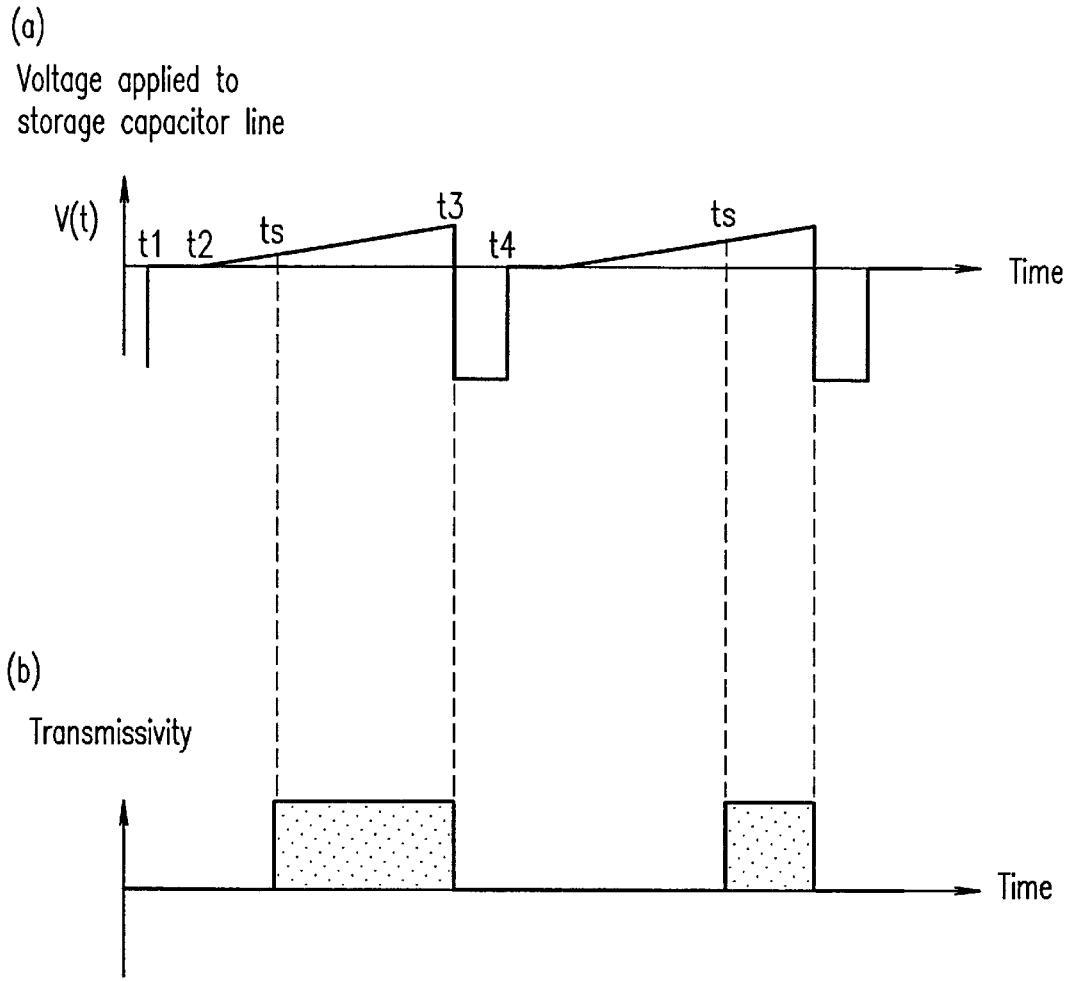
FIG. 11 shows the transition of a voltage V(t) with the passage of time in section (a) and the transmissivity of one of the pixels included in the active matrix liquid crystal panel 200 in section (b).

Section (a) of FIG. 11 shows the transition of the voltage V(t) with the passage of time. Section (b) of FIG. 11 shows a transmissivity of one of the pixels included in the active matrix liquid crystal panel 200. In section (a) of FIG. 11, it is assumed that a period from time t1 to time t4 is one frame.

The switch SW is turned ON between time t1 and time t2. While the switch SW is ON, the voltage of 0V is applied to both the liquid crystal capacitor C1 and the storage capacitor C2 because the voltage V(t) is 0 V during a period from time t1 to time t2 as shown in section (a) of FIG. 11. Thereafter, the switch SW is turned OFF before time t2. The voltage Vs is lower than the threshold value (Vth) that the ferroelectric liquid crystal material inherently has.

During a period from time t2 to time t3, the voltage V(t) changes with the passage of time as shown in section (a) of FIG. 11. Voltages V1 and V2 to be applied to the liquid crystal capacitor C1 and the storage capacitor C2, respectively, are expressed as shown below:

$$V1=C2\times V(t)/(C1+C2)+Vs$$

$$V2=C1\times V(t)/(C1+C2)-Vs$$

Thus, at time when Vth=V1 is satisfied, i.e. at time ts, the ferroelectric liquid crystal material starts to respond.

During a period from time t3 to time t4, the voltage V(t) transitions like a pulse having an opposite polarity to the voltage V(t) during the period from time t2 to time t3.

Each of the signal voltages Vs is set so that V1<−Vth is satisfied. Thus, the orientation of the ferroelectric liquid crystal material is reset to the initial state without fail in response to the application of the signal voltage Vs.

When the polarizers are disposed in a crossed Nicols state such that the initial orientation state of the liquid crystal material displays a black field, transmitted light is observed substantially between time ts and time t3 within one frame. The optical response of the active matrix liquid crystal panel 200 is like a pulse waveform as shown in section (b) of FIG. 11. Since the ferroelectric liquid crystal material having a high response speed is used in this embodiment, the optical-response period of the liquid crystal material substantially corresponds to the period from time ts to time t3. However, the optical response waveform in fact reflects the response waveform of the liquid crystal material.

Alternatively, even when the waveform of the voltage V(t) is fixed, time ts can be changed by changing the signal voltage Vs. Thus, when the active matrix liquid crystal panel 200 is driven at 60 Hz, the human eye perceives that the gray scale is controlled by the signal voltage Vs.

Figure 12:
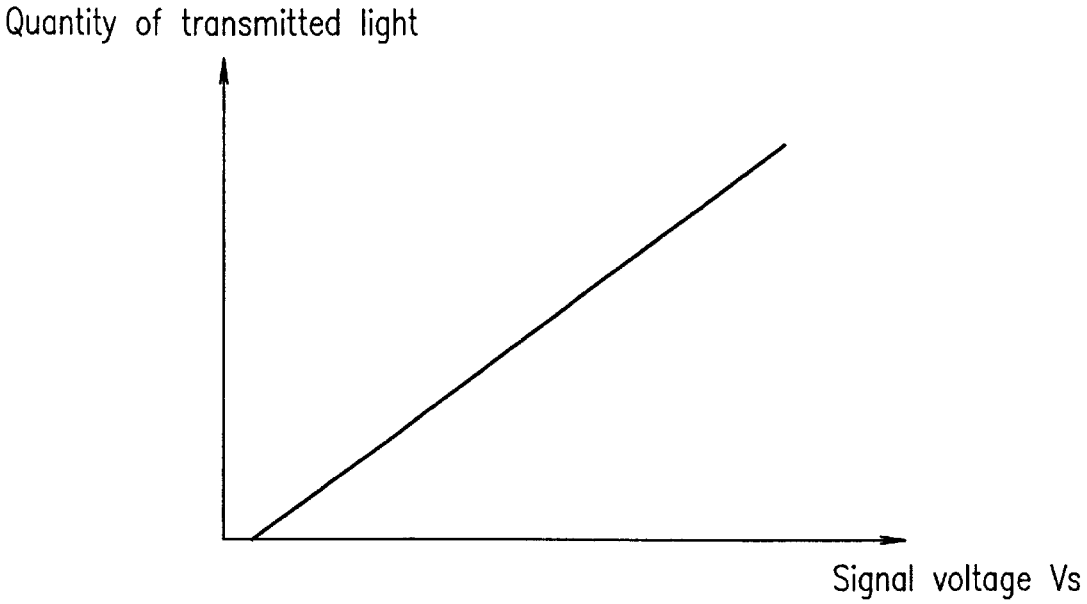
FIG. 12 shows a relationship between the voltage V(t) and the quantity of transmitted light perceived by the human eye.

FIG. 12 shows a relationship between the signal voltage Vs and the quantity of transmitted light perceived by the human eye.

A gray scale display principle as shown in FIG. 12 can be achieved in the TFT panel by applying the voltage V(t) of section (a) of FIG. 11 to the storage capacitor line.

It is preferable that writing data in all the pixels be completed between time t1 and time t2. That is, the signal voltage Vs is different between respective pixels, and is written in the drain of each pixel.

During the period from time t2 to time t3, a voltage having a waveform that changes with the passage of time as shown in part (a) of FIG. 11 is applied to the storage capacitor line, whereby each pixel starts to respond at time ts corresponding to the signal voltage Vs applied thereto.

During the period from time t3 to time t4, as shown in FIG. 11, a voltage that resets the orientation of the ferroelectric liquid crystal material to the initial state is supplied to the storage capacitor line.

The response start time of the respective pixels can be set to time ts corresponding to the respective signal voltages Vs applied thereto. In addition, the orientation of the liquid crystal material is simultaneously reset to the initial state for all the pixels. As a result, driving the liquid crystal display device at 60 Hz provides images with an analog gray scale based on the control of the signal voltage Vs to the human eye.

Even when, a cholesteric liquid crystal material having a quick-responsive threshold property is used instead of the ferroelectric liquid crystal material used in embodiment 2, an analog gray scale liquid crystal display device can be driven by the driving method described in embodiment 2.

Alternatively, even when a nematic liquid crystal material having an orientation adjusted so as to have a quick-responsive threshold property (for example, a thin 180° twist cell) is used instead of the ferroelectric liquid crystal material used in embodiment 2, an analog gray scale liquid crystal display device can be driven by the driving method described in embodiment 2 because of the quick-responsive threshold property of the liquid crystal material with respect to the voltage.

For example, one frame shown in part (a) of FIG. 11 (e.g., time t1 to time t4) may be referred to as one subframe, and a light source may be sequentially switched from one to another among the three primary color (R, G, B) light sources for each subframe. In a field serial color display method in which one frame includes three subframes, high quality images can be obtained as a result of the effects of high speed analog gray scale display. The high speed analog gray scale display is applicable to a high frequency driving with one frame including six subframes such as RGBRGB because of its high operation speed.

In Embodiment 2, the backlight may be turned OFF during either the period for writing the signal voltage Vs in the pixels or the reset period within one frame of section (a) of FIG. 11. Even if the backlight is OFF during either of the periods, a similar analog gray scale to that described above can be obtained, whereby lower power consumption can be achieved.

Figure 15:
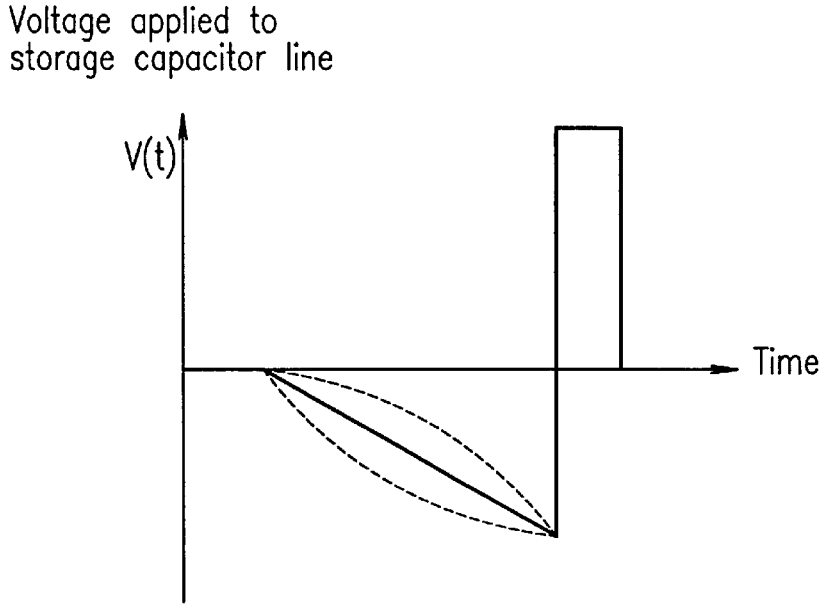
FIG. 15 shows an example of the voltage V(t) to be applied to the storage capacitor line.
Figure 16:
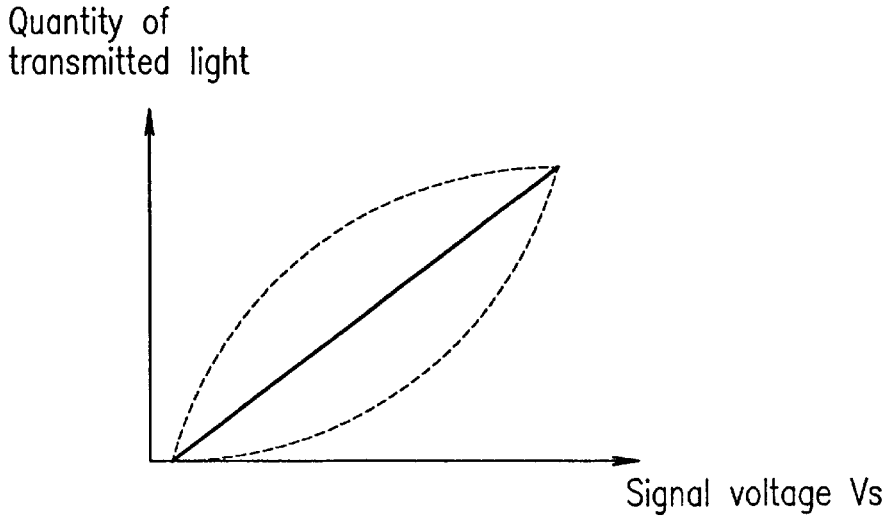
FIG. 16 shows a relationship between the voltage V(t) and the quantity of transmitted light when the voltage V(t) shown in FIG. 15 is applied to the storage capacitor line.

The waveform of the voltage V(t) to be applied to the storage capacitor line is not limited to that shown in section (a) of FIG. 11, For example, the voltage V(t) to be applied to the storage capacitor line may change as shown in FIG. 15. FIG. 16 shows a relationship between the signal voltage Vs and the quantity of the transmitted light when the voltage V(t) of FIG. 15 is applied to the storage capacitor line. As shown in FIG. 16, a signal voltage-quantity of transmitted light property, i.e., a gray scale property, can be continuously controlled by continuously changing the waveform of the voltage to be applied to the storage capacitor line.

Furthermore, the gray scale property such as a gamma characteristic and the gray scale balance can be readily controlled in the continuous manner by adjusting a writing voltage Vs of an image signal.

(Embodiment 3)

A liquid crystal display device according to embodiment 3 of the present invention will be described with reference to FIGS. 13 and 14.

In embodiment 3, an antiferroelectric liquid crystal material is used instead of the ferroelectric liquid crystal material used in the active matrix liquid crystal panel 200 of embodiment 2. According to embodiment 3, an analog gray scale liquid crystal display device can be achieved even with the antiferroelectric liquid crystal material only capable of displaying two-tone images.

Figure 13:
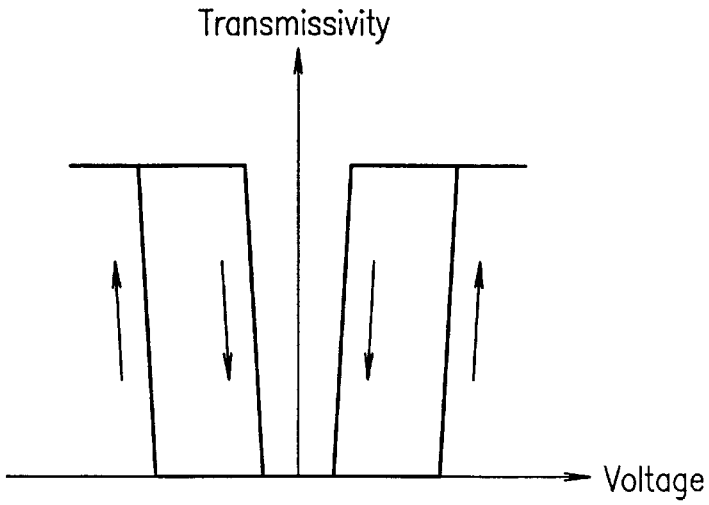
FIG. 13 shows a relationship between a voltage to be applied to an antiferroelectric liquid crystal material and the transmissivity of the liquid crystal panel having the antiferroelectric liquid crystal material.

FIG. 13 shows a relationship between a voltage that is applied to the antiferroelectric liquid crystal material and the transmissivity of a liquid crystal panel including the antiferroelectric liquid crystal material. Hereinafter, the liquid crystal panel including the antiferroelectric liquid crystal material is referred to as an antiferroelectric liquid crystal panel. The transmissivity of the antiferroelectric liquid crystal panel has the quick-responsive threshold property with respect to a voltage to be applied to the antiferroelectric liquid crystal material, as shown in FIG. 13.

In this liquid crystal mode, the antiferroelectric liquid crystal panel can be used in such a manner that a light-state is displayed when a positive or negative voltage is applied whereas a dark-state is displayed when the voltage of 0 V is applied. That is, polarizing plates are disposed in a crossed Nicols state, and the angle of the polarizer is adjusted such that the polarizing plates are in the extinction position with respect to each other when the voltage is 0 V.

The driving principle of embodiment 3 is similar to that of embodiment 2 when the driving voltage has a positive polarity. When the driving voltage has a negative polarity, the driving principle of embodiment 3 is also similar to that of embodiment 2 except the polarity of the voltage is inverted.

Figure 14A:
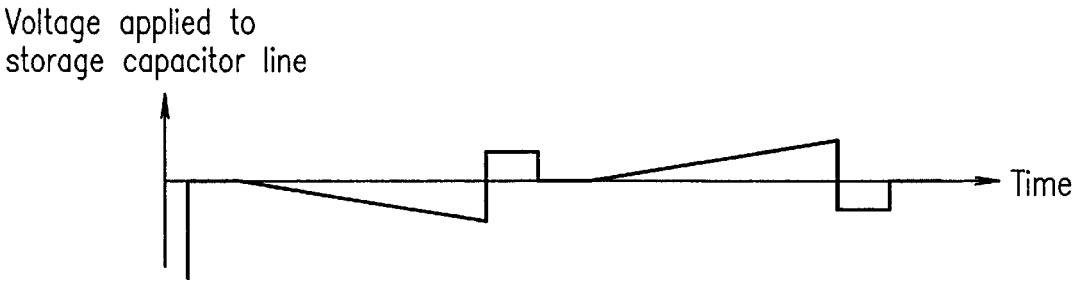
FIG. 14A shows a waveform of a voltage to be applied to a storage capacitor line of the antiferroelectric liquid crystal panel.
Figure 14B:
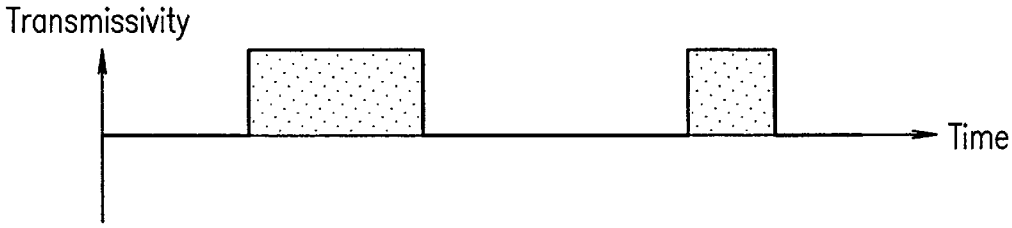
FIG. 14B shows the transmissivity of the antiferroelectric liquid crystal panel when the voltage shown in FIG. 14A is supplied to the storage capacitor line.

FIG. 14A shows a waveform of a voltage to be applied to a storage capacitor line of the antiferroelectric liquid crystal panel. FIG. 14B shows the transmissivity of the antiferroelectric liquid crystal panel when the voltage shown in FIG. 14A is supplied to the storage capacitor line. A portion of the waveform for resetting the orientation of the liquid crystal material to the initial state (dark state) should be carefully determined such that the portion does not cause the liquid crystal material to be in a light-state of an inversive polarity.

By such a driving method, the response start time of the respective pixels can be set to time ts (not shown) corresponding to the respective signal voltages Vs applied thereto. In addition, the orientation of the liquid crystal material is simultaneously reset to the initial state for all the pixels. As a result, driving the liquid crystal display device at 60 Hz provides images with an analog gray scale based on the control of the signal voltage Vs to the human eye.

In the antiferroelectric liquid crystal panel of the present embodiment, the storage capacitor lines are connected such that the even-numbered lines and the odd-numbered lines are separately connected together, and connected to two different power supplies, respectively, whereby the line-inverted driving can be realized.

Even when a cholesteric liquid crystal material having a quick-responsive threshold property with respect to the voltage is used instead of the antiferroelectric liquid crystal material used in embodiment 3, an analog gray scale liquid crystal display device can be driven by the driving method described in embodiment 3.

Alternatively, even when a nematic liquid crystal material having an orientation adjusted so as to have a quick-responsive threshold property (for example, a thin 180° twist cell) is used instead of the antiferroelectric liquid crystal material used in embodiment 3, an analog gray scale liquid crystal display device can be driven by the driving method described in embodiment 3 because of the quick-responsive threshold property of the liquid crystal material with respect to the voltage.

The waveform of the voltage V(t) to be applied to the storage capacitor line is not limited to that shown in FIG. 14A. For example, the voltage V(t) may transition as shown in FIG. 15. FIG. 16 shows a relationship between the signal voltage Vs and the quantity of the transmitted light when the voltage V(t) of FIG. 15 is applied to the storage capacitor line. As shown in FIG. 16, a signal voltage-quantity of transmitted light property, i.e., a gray scale property can be continuously controlled by continuously changing the waveform of the voltage to be applied to the storage capacitor line.

Furthermore, the gray scale property such as a gamma characteristic and the gray scale balance can be readily controlled in the continuous manner by adjusting a writing voltage Vs of an image signal.

(Embodiment 4)

Figure 17:
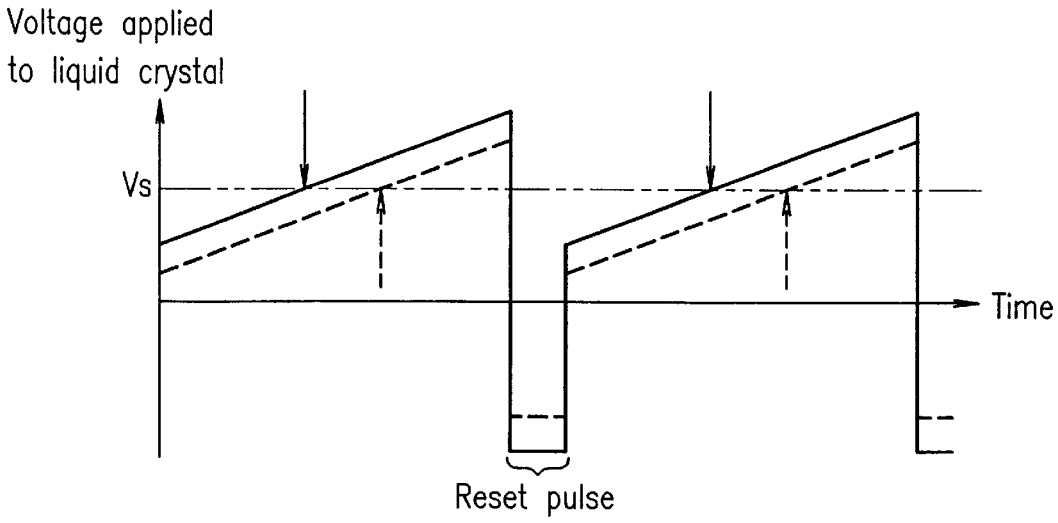
FIG. 17 shows a voltage which is applied to a counter electrode of the ferroelectric liquid crystal panel 10.

A liquid crystal display device according to embodiment 4 of the present invention will be described with reference to FIGS. 17–19. In embodiment 4, the ferroelectric liquid crystal panel 10 shown in FIG. 1 is used. FIG. 17 shows a voltage to be applied to a counter electrode of the ferroelectric liquid crystal panel 10. As shown in FIG. 17, a waveform of a solid line is same as that of a broken line, but the amplitudes of the solid and broken lines are different.

As described above, the response property of the ferroelectric liquid crystal material to a voltage provides a distinctive threshold property as shown in FIG. 3. Thus, between the voltage waveforms of the solid line and the broken line shown in FIG. 17, the response timing of the liquid crystal material is different. Solid and broken arrows in FIG. 17 indicate points at which the solid line and the broken line reach the threshold voltage Vs of the ferroelectric liquid crystal material, respectively.

A waveform shown in FIG. 17 includes a pulse waveform for resetting the ferroelectric liquid crystal material which responded to the threshold voltage Vs to the initial state before the material responded to the applied voltage. For convenience, this pulse waveform is hereinafter referred to as a reset pulse. The reset pulse is adjusted to a pulse height such that the reset pulse can reset the state of the ferroelectric liquid crystal material to the initial state before the material responded to the applied voltage regardless of the amplitude of the waveform shown in FIG. 17 as long as the voltage to be applied to the ferroelectric liquid crystal material is in an appropriate voltage range.

Figure 18:
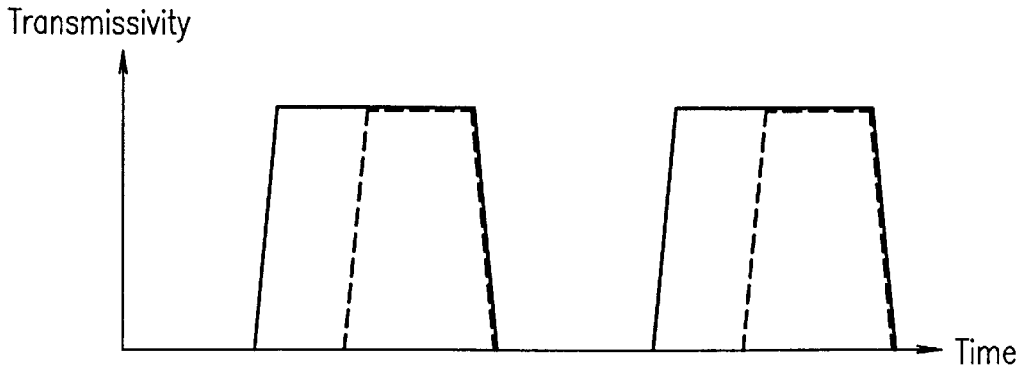
FIG. 18 shows a transition of the transmissivity of the ferroelectric liquid crystal panel 10 with the passage of time, when the ferroelectric liquid crystal responds to the signal voltages.

FIG. 18 shows how the transmissivity of the ferroelectric liquid crystal panel 10 transitions with the passage of time under the above-described conditions.

As shown in FIG. 18, the response timing is different between the solid line and the broken line, whereas the ferroelectric liquid crystal material is reset to the initial dark-state at the same timing for both the solid and broken lines. That is, the length of time in which the light-state is displayed is different between the solid line and the broken line. In the present embodiment, the ferroelectric liquid crystal panel 10 is driven at 60 Hz, and a light source (not shown) is provided under the ferroelectric liquid crystal panel 10. The human eye does not perceive that the ferroelectric liquid crystal panel 10 blinks at 60 Hz, but senses the quantity of light corresponding to an integral value of the transmissivity with respect to the time as a brightness. Thus, although the ferroelectric liquid crystal panel 10 provides a continuous brightness to the human eye for both the solid line and the broken line of FIG. 18, the brightness for the solid line looks greater for the human eye than the brightness for the broken line.

Figure 19:
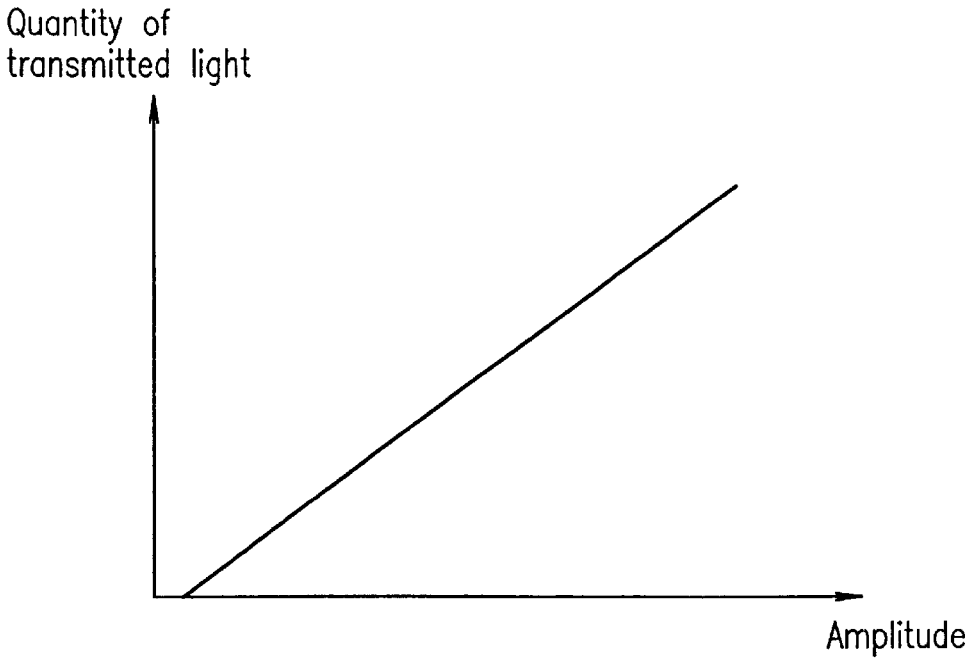
FIG. 19 shows a relationship between the amplitude of a voltage having a waveform shown in FIG. 17 that is applied to the ferroelectric liquid crystal material and the quantity of transmitted light perceived by the human eye.

FIG. 19 shows a relationship between the amplitude of the voltage having the waveform shown in FIG. 17 which is applied to the ferroelectric liquid crystal material (horizontal axis) and a quantity of transmitted light that is perceived by the human eye (vertical axis).

As shown in FIG. 19, the quantity of transmitted light increases very smoothly as the amplitude of the waveform of the voltage which is applied to the ferroelectric liquid crystal material shown in FIG. 17 increases. That is, even when the ferroelectric liquid crystal material is used, an analog gray scale can be obtained by controlling the amplitude of the waveform of the voltage which is applied to the ferroelectric liquid crystal material shown in FIG. 17. Thus, by using a liquid crystal mode which has a quick-responsive threshold property with respect to the voltage, a liquid crystal display device (light valve) in which the analog gray scale is used for displaying is achieved by controlling the amplitude of the waveform of the voltage which is applied to the ferroelectric liquid crystal material shown in FIG. 17.

An antiferroelectric liquid crystal material having a three-state stability may be used instead of the ferroelectric liquid crystal material used in embodiment 1. With the antiferroelectric liquid crystal material, the analog gray scale can be obtained by controlling the amplitude of the waveform of the voltage which is applied to the liquid crystal material shown in FIG. 17.

Even when a cholesteric liquid crystal material having a quick-responsive threshold property with respect to the voltage is used instead of the ferroelectric liquid crystal material used in embodiment 4, an analog gray scale liquid crystal display device can be driven by the driving method described in embodiment 4.

Alternatively, even when a nematic liquid crystal material having an orientation adjusted so as to have a quick-responsive threshold property (for example, a thin 180° twist cell) is used instead of the ferroelectric liquid crystal material used in embodiment 4, an analog gray scale liquid crystal display device can be driven by the driving method described in embodiment 4 because of the quick-responsive threshold property of the liquid crystal material with respect to the voltage.

(Embodiment 5)

A liquid crystal display device according to embodiment 5 of the present invention will be described with reference to FIG. 20.

In embodiment 5, the method used in embodiment 4 is applied to the TFT driving method. That is, according to embodiment 5, an analog gray scale liquid crystal display device can be realized even with the ferroelectric liquid crystal material which can only provide a two-level gray scale display.

Figure 20:
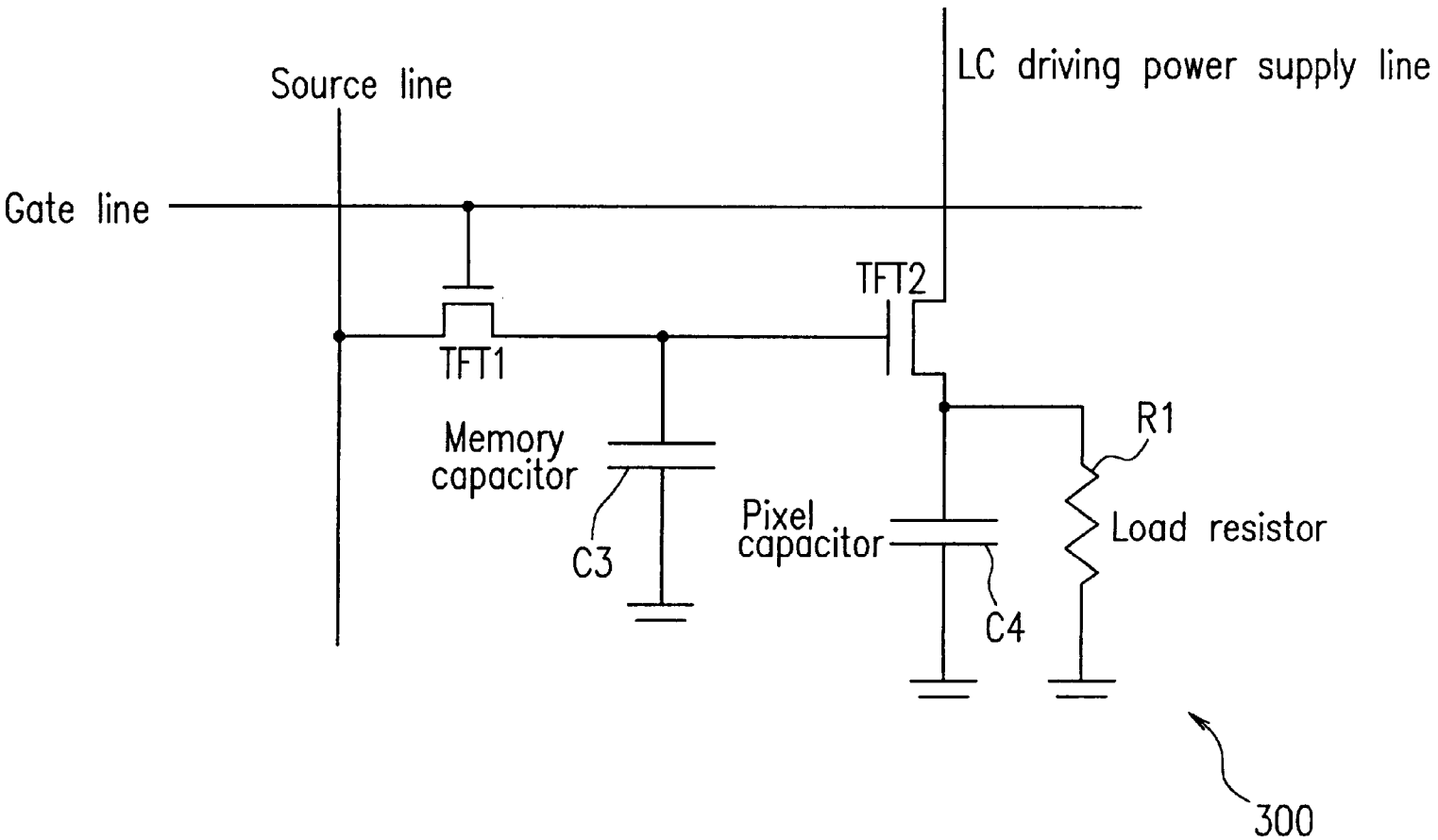
FIG. 20 shows a portion of an active matrix liquid crystal panel 300 according to embodiment 5 of the present invention.

FIG. 20 shows a portion of an active matrix liquid crystal panel 300 according to embodiment 5 of the present invention. The active matrix liquid crystal panel 300 includes a transistor TFT1, a transistor TFT2, a memory capacitor C3, a pixel capacitor C4, a load resistor R1, a gate line, a source line, and a liquid crystal driving power supply line.

A TFT substrate and a counter substrate of the active matrix liquid crystal panel 300 are the same as the typical substrate as conventionally used. The ferroelectric liquid crystal material is injected between the TFT substrate and the counter substrate, and appropriately oriented, and the active matrix liquid crystal panel 300 is thus fabricated.

Now, an operation of embodiment 5 will be described in detail with reference to FIGS. 21–23.

Figure 21:
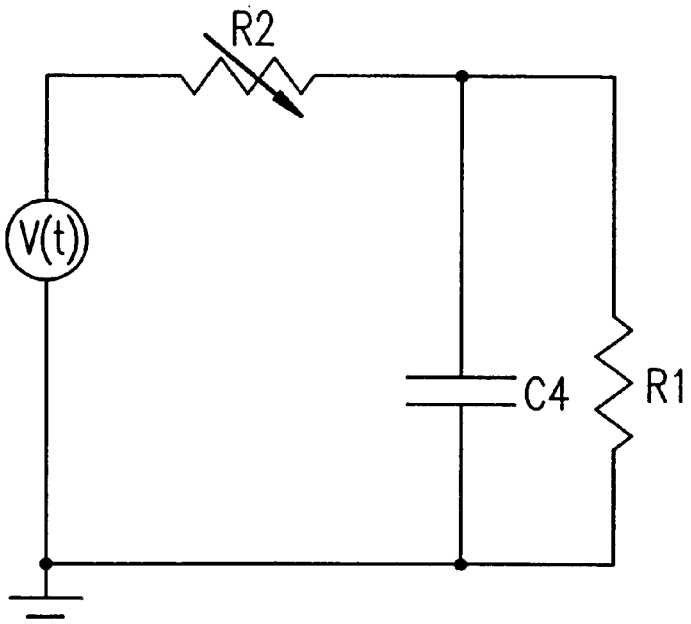
FIG. 21 shows an equivalent circuit of one of the pixels included in the active matrix liquid crystal panel 300.

FIG. 21 shows an equivalent circuit of one of pixels included in the active matrix liquid crystal panel 300. A variable resistor R2 of FIG. 21 corresponds to the transistor TFT2 of FIG. 20. A resistance value of the transistor TFT2 is controlled by a voltage to be written in the memory capacitor. That is, an pixel capacitor of the conventional TFT liquid crystal panel corresponds to the memory capacitor, and a predetermined voltage can be written in the memory capacitor by a conventionally-employed method. Furthermore, the pixel capacitor C4 is parallel to the fixed resistor R1. The equivalent circuit shown in FIG. 21 includes a power supply for supplying a voltage V(t) which changes with the passage of time.

Figure 22:
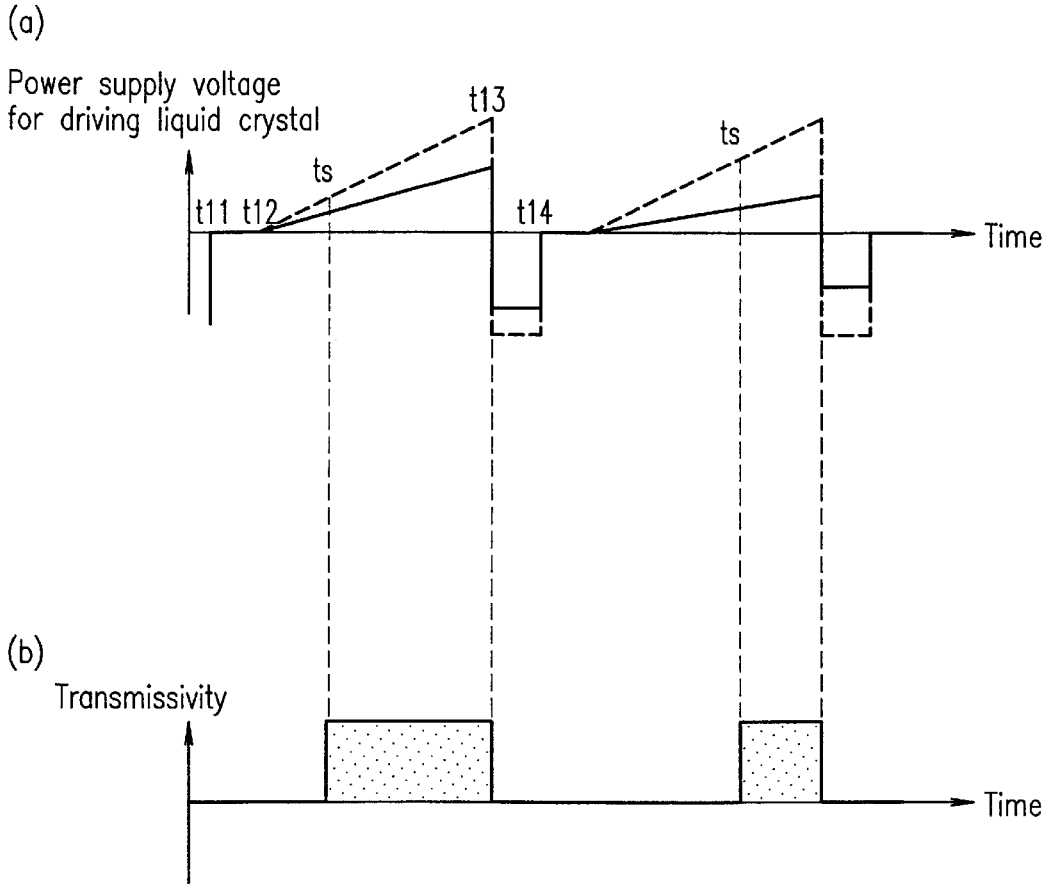
FIG. 22 shows the transition of the voltage V(t) with the passage of time in section (a) and shows a transmissivity of one of the pixels included in the active matrix liquid crystal panel 300 (b).

Section (a) of FIG. 22 shows the transition of the voltage V(t) with the passage of time. Section (b) of FIG. 22 shows a transmissivity of one of the pixels included in the active matrix liquid crystal panel 300. In section (a) of FIG. 22, it is assumed that a period from time t11 to time t14 is one frame.

During a period from time t11 to time t12, the variable resistor R2 is adjusted. During this period, the voltage V(t)=0 V, and no voltage is thus applied to the pixel capacitor C4. The adjustment of the variable resistor R2 is completed between time t11 and time t12.

During a period from time t12 and time t13, the voltage V(t) transitions with the passage of time as shown in section (a) of FIG. 22. A voltage Vlc to be applied to the pixel capacitor C4 is expressed as shown below:

$$Vlc=R1\times V(t)/(R1+R2)$$

Thus, at time ts when Vlc=Vth is satisfied, the ferroelectric liquid crystal material starts to respond. (Vth denotes the threshold voltage of the ferroelectric liquid crystal material.)

During a period from time t13 to time t14, the voltage V(t) transitions like a pulse having an opposite polarity to the voltage V(t) during the period from time t12 to time t13. The voltage V(t) is set so that Vlc<−Vth is satisfied. Thus, the orientation of the ferroelectric liquid crystal material is reset to the initial state without fail.

Thus, when the polarizers are disposed in a crossed Nicols state such that the initial orientation state of the liquid crystal material displays a black field, transmitted light is observed substantially between time ts and time t13 within one frame. The optical response is like a pulse waveform as shown in section (b) of FIG. 22. Since the ferroelectric liquid crystal material having a high response speed is used in this embodiment, the optical-response period of the liquid crystal material substantially corresponds to the period from time ts to time t13. However, the optical response waveform in fact reflects the response waveform of the liquid crystal material.

Alternatively, even when the waveform of the voltage V(t) is fixed, time ts can be changed by changing the variable resistance R2. Thus, when the active matrix liquid crystal panel 300 is driven at 60 Hz, the human eye perceives that the gray scale is controlled by the variable resistance R2.

Figure 23:
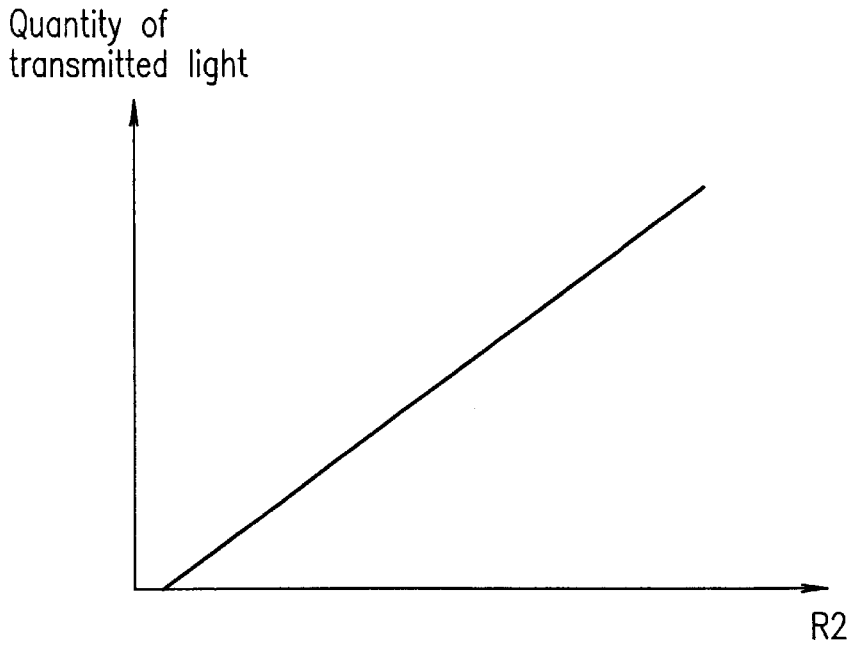
FIG. 23 shows a relationship between the variable resistance R2 and the quantity of transmitted light.

FIG. 23 shows a relationship between the variable resistance R2 and the quantity of transmitted light. The voltage V(t) shown in section (a) of FIG. 22 is applied to the ferroelectric liquid crystal material, whereby the gray scale principle as shown in FIG. 23 is realized in the TFT panel.

It is preferable that writing data in all the pixels be completed between time t11 and time t12. That is, the variable resistance R2 is different between respective pixels. In other words, the variable resistance is controlled by the memory capacitor of each pixel.

During a period from time t12 and time t13, the voltage to be applied to the ferroelectric liquid crystal material is as shown in section (a) of FIG. 22. Thus, each pixel starts to respond at time ts in response to a voltage which is divided by the variable resistance R2 and applied to the ferroelectric liquid crystal material.

During the period from time t13 to time t14, as shown in section (a) of FIG. 22, a voltage that resets the orientation of the ferroelectric liquid crystal material to the initial state is applied to the liquid crystal material.

As described above, the response start time of the each pixel can be set to time ts corresponding to the voltage written in the memory capacitor. In addition, the orientation of the liquid crystal material is simultaneously reset to the initial state for all the pixels. As a result, driving the active matrix liquid crystal panel 300 at about 60 Hz provides images with an analog gray scale based on the voltage written in the memory capacitor to the human eye.

That is, according to embodiment 5, an analog gray scale liquid crystal display device can be realized even with the ferroelectric liquid crystal material only capable of displaying two-tone images.

Even when a cholesteric liquid crystal material having a quick-responsive threshold property is used instead of the ferroelectric liquid crystal material used in embodiment 5, an analog gray scale liquid crystal display device can be driven by the driving method described in embodiment 5.

Alternatively, even when a nematic liquid crystal material having an orientation adjusted so as to have a quick-responsive threshold property (for example, a thin 180° twist cell) is used instead of the ferroelectric liquid crystal material used in embodiment 5, an analog gray scale liquid crystal display device can be driven by the driving method described in embodiment 5 because of the quick-responsive threshold property of the liquid crystal material with respect to the voltage.

For example, one frame shown in part (a) of FIG. 22 (e.g., time t11 to time t14) may be referred to as one subframe, and a light source may be sequentially switched from one to another among the three primary color (R, G, B) light sources for each subframe. In a field serial color display method in which one frame includes three subframes, high quality images can be obtained as a result of effects of high speed analog gray scale display. The high speed analog gray scale display is applicable to a high frequency driving with one frame including six subframes such as RGBRGB because of its high operation speed.

In Embodiment 5, the backlight may be turned OFF during either the period for writing the signal voltage Vs in the pixels or the reset period within one frame of section (a) of FIG. 22. Even if the backlight is OFF during either of the periods, a similar analog gray scale to that described above can be obtained, whereby lower power-consumption can be achieved.

Figure 26:
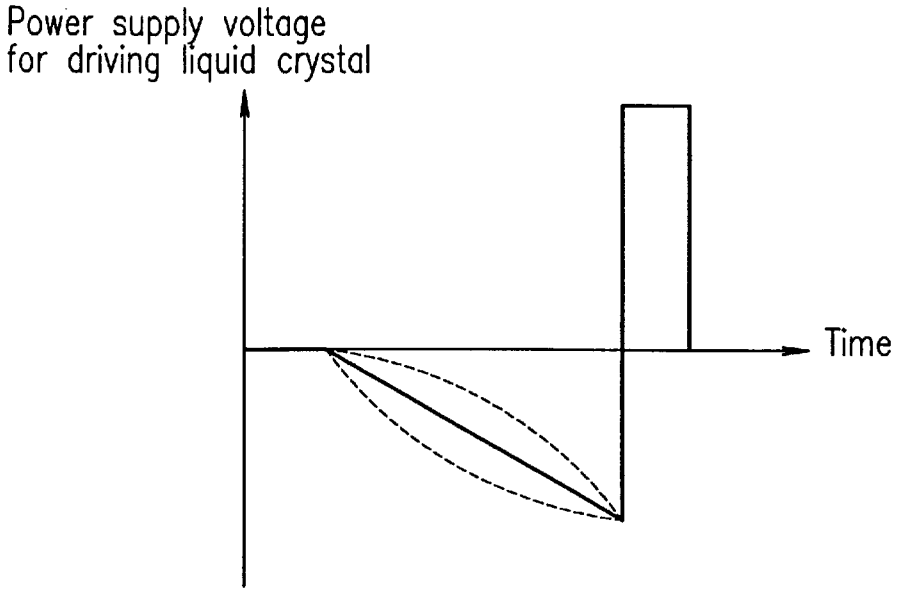
FIG. 26 shows an example of the voltage V(t) to be applied to the storage capacitor line.
Figure 27:
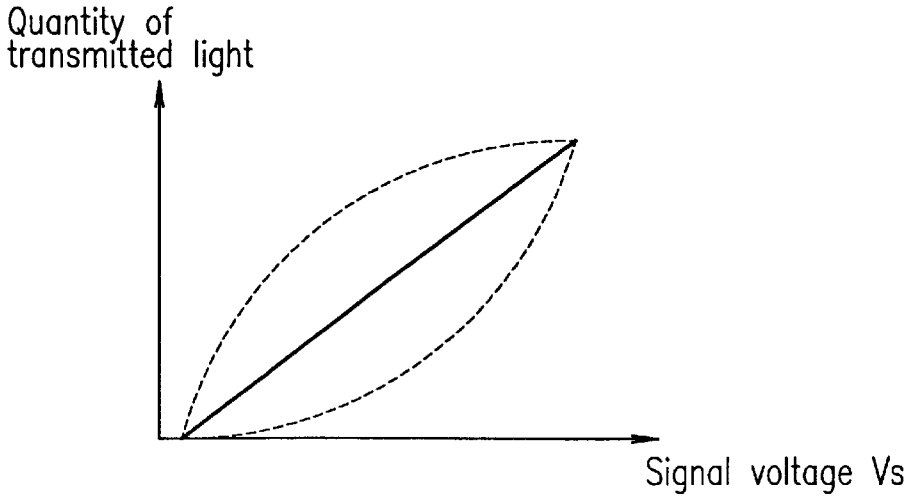
FIG. 27 shows a relationship between the voltage V(t) and the quantity of the transmitted light when the voltage V(t) of FIG. 26 is applied to the liquid crystal material.

The waveform of the voltage V(t) to be applied to the ferroelectric liquid crystal material is not limited to that shown in section (a) of FIG. 22, For example, the voltage V(t) to be applied to the liquid crystal material may transition as shown in FIG. 26. FIG. 27 shows a relationship between the voltage V(t) and the quantity of the transmitted light when the voltage V(t) of FIG. 26 is applied to the liquid crystal material. The quantity of transmitted light can be continuously controlled by continuously changing the waveform of the voltage to be applied to the ferroelectric liquid crystal material as shown in FIG. 26.

Furthermore, the gray scale property such as a gamma characteristic and the gray scale balance can be readily controlled in the continuous manner by adjusting a writing voltage Vs of an image signal.

(Embodiment 6)

A liquid crystal display device according to embodiment 6 of the present invention will be described with reference to FIGS. 24 and 25.

In embodiment 6, an antiferroelectric liquid crystal material is used instead of the ferroelectric liquid crystal material used in the active matrix liquid crystal panel 300 of embodiment 5. According to embodiment 6, an analog gray scale liquid crystal display device can be achieved even with the antiferroelectric liquid crystal material only capable of displaying two-tone images.

Figure 24:
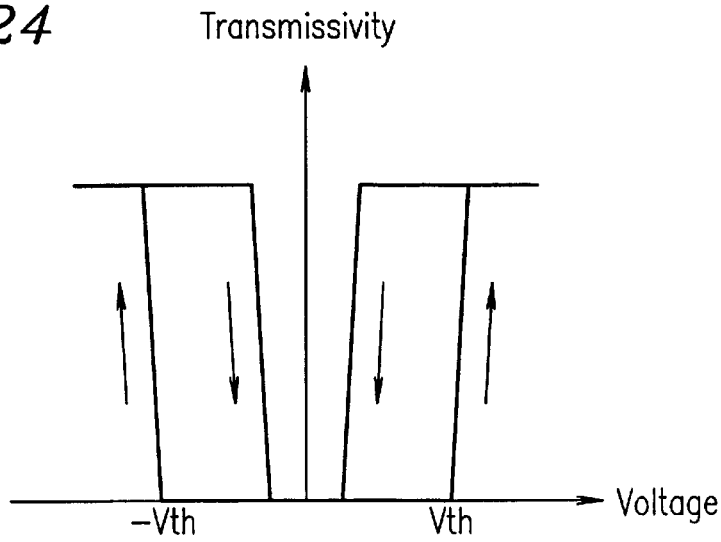
FIG. 24 shows a relationship between a voltage that is applied to the antiferroelectric liquid crystal material and the transmissivity of a liquid crystal panel including the antiferroelectric liquid crystal material.

FIG. 24 shows a relationship between a voltage that is applied to the antiferroelectric liquid crystal material and the transmissivity of a liquid crystal panel including the antiferroelectric liquid crystal material. Hereinafter, the liquid crystal panel including the antiferroelectric liquid crystal material is referred to as an antiferroelectric liquid crystal panel. The transmissivity of the antiferroelectric liquid crystal panel has the quick-responsive threshold property with respect to a voltage to be applied to the antiferroelectric liquid crystal material, as shown in FIG. 24.

In this liquid crystal mode, the antiferroelectric liquid crystal panel can be used in such a manner that a light-state is displayed when a positive or negative voltage is applied whereas a dark-state is displayed when the voltage of 0 V is applied. That is, polarizing plates are disposed in a crossed Nicols state, and the angle of the polarizer is adjusted such that the polarizing plates are in the extinction position with respect to each other when the voltage is 0 V.

The driving principle of embodiment 6 is similar to that of embodiment 5 when the driving voltage has a positive polarity. When the driving voltage has a negative polarity, the driving principle of embodiment 6 is also similar to that of embodiment 5 except the polarity of the voltage is inversive.

Figure 25:
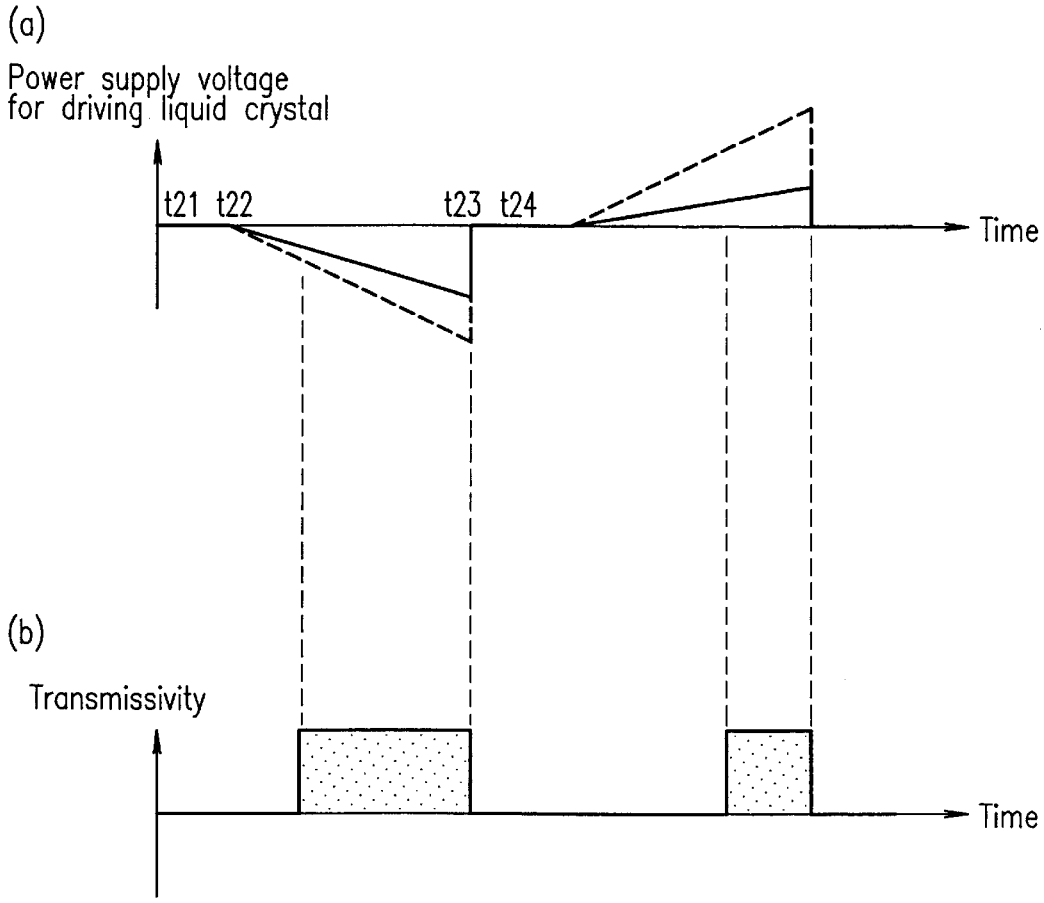
FIG. 25 shows a waveform of a voltage to be applied to the antiferroelectric liquid crystal panel in section (a) and the transmissivity of the antiferroelectric liquid crystal panel in Section (b).

Section (a) of FIG. 25 shows a waveform of a voltage to be applied to the antiferroelectric liquid crystal panel. Section (b) of FIG. 25 shows the transmissivity of the antiferroelectric liquid crystal panel. In section (a) of FIG. 25, the voltage of a reset pulse for resetting the orientation of the liquid crystal material to the initial state (dark state) is 0 V. A pulse having an opposite polarity also can be used to reset the orientation of the liquid crystal material to the initial state as long as the pulse is sufficiently low so that the liquid crystal material is not turned to the light state.

By such a driving method, the response start time of the respective pixels can be set to time ts (not shown) corresponding to the respective signal voltages Vs applied thereto. In addition, the orientation of the liquid crystal material is simultaneously reset to the initial state for all the pixels. As a result, driving the liquid crystal display device at 60 Hz provides images with an analog gray scale based on the control of the signal voltage Vs to the human eye.

In the antiferroelectric liquid crystal panel of the present embodiment, the storage capacitor lines are connected such that the even-numbered lines and the odd-numbered lines are separately connected together, and connected to two different power supplies, respectively, whereby the line-inverted driving can be realized.

Even when a cholesteric liquid crystal material having a quick-responsive threshold property with respect to the voltage is used instead of the antiferroelectric liquid crystal material used in embodiment 6, an analog gray scale liquid crystal display device can be driven by the driving method described in embodiment 6.

Alternatively, even when a nematic liquid crystal material having an orientation adjusted so as to have a quick-responsive threshold property (for example, a thin 180° twist cell) is used instead of the antiferroelectric liquid crystal material used in embodiment 6, an analog gray scale liquid crystal display device can be driven by the driving method described in embodiment 6 because of the quick-responsive threshold property of the liquid crystal material with respect to the voltage.

The waveform of the voltage V(t) to be applied to the liquid crystal material is not limited to that shown in section (a) of FIG. 25. For example, the voltage V(t) to be applied to the antiferroelectric liquid crystal material may transition as shown in FIG. 26. FIG. 27 shows a relationship between the signal voltage Vs and the quantity of the transmitted light when the voltage V(t) of FIG. 26 is applied to the liquid crystal material. As shown in FIG. 27, the signal voltage-quantity of transmitted light property, i.e., the gray scale property can be continuously controlled by continuously changing the waveform of the voltage.

Furthermore, the gray scale property such as a gamma characteristic and the gray scale balance can be readily controlled in the continuous manner by adjusting a writing voltage Vs of an image signal.

Figure 28:
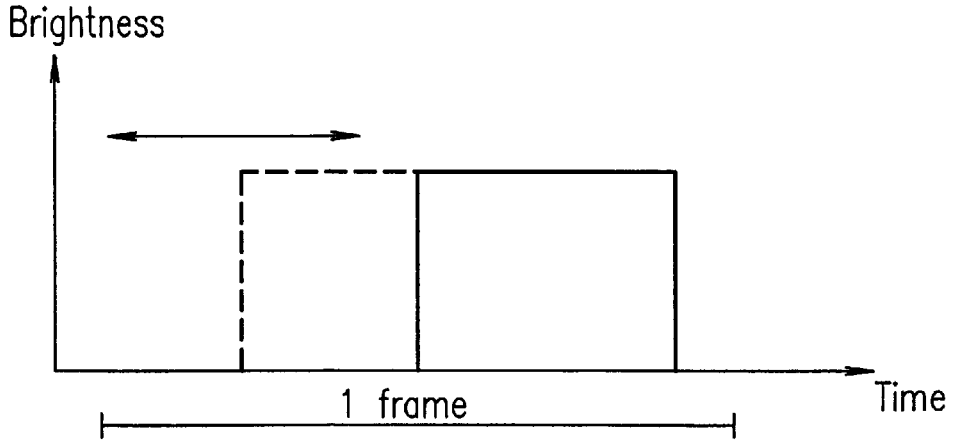
FIG. 28 shows examples of a response period and a reset period of the liquid crystal material according to the present invention.
Figure 29:
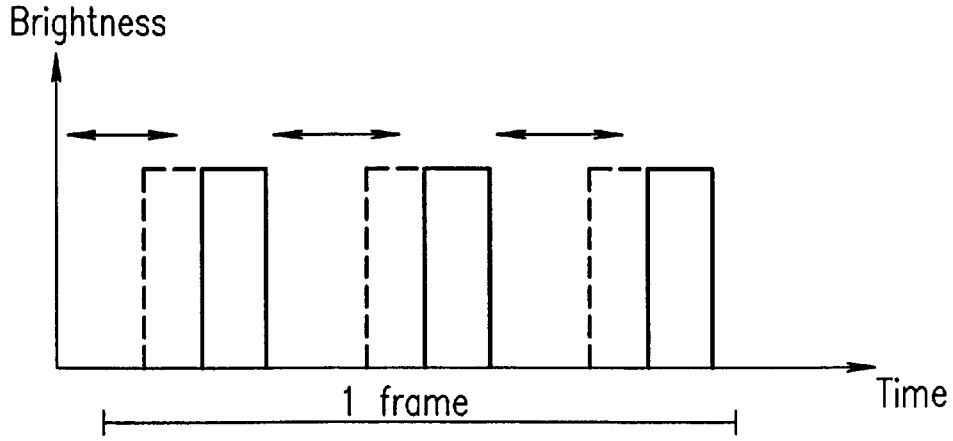
FIG. 29 shows examples of a response period and a reset period of the liquid crystal material according to the present invention.

In embodiments 1–6, as shown in FIG. 28, one frame includes one response period and one reset period of the liquid crystal material. However, one frame may include a plurality of response periods and a plurality of reset periods as shown in FIG. 29. (Arrows in FIGS. 28 and 29 denote that a response period of the liquid crystal material can be changed.)

Furthermore, in embodiments 1–6, an analog gray scale property is obtained by continuously changing a voltage to be applied to the liquid crystal material or the like. However, in the present invention, a non-linear element or the like may be used to control the voltage to be applied to the liquid crystal material or the like, thereby changing the rising edge of the voltage to be applied to the liquid crystal material or the like and, as a result, obtaining an analog gray scale property.

Furthermore, in embodiments 1–6, by changing the voltage to be applied to the liquid crystal material or the like, a transition of the liquid crystal panel from a dark-state to a light-state is timed while the liquid crystal material returns from a light state to a dark state (initial orientation). However, in the present invention, a transition of the liquid crystal panel from a light state to a dark state may be timed by changing the voltage to be applied to the liquid crystal material or the like.

A liquid crystal display device of the present invention includes a main substrate having a main electrode, a counter substrate having a counter electrode, a liquid crystal material interposed between the main substrate and the counter substrate, and a control section for controlling a response start time of the liquid crystal material by a potential difference between a main electrode voltage that is applied to the main electrode during one frame and a counter electrode voltage that changes in a substantially continuous manner during the one frame, and for changing a transmissivity of the liquid crystal display device based on a magnitude of the main electrode voltage.

With such a liquid crystal display device, an analog gray scale property (capable of displaying images with a full gray scale) can be obtained even in a liquid crystal mode having a limited number of gray scales (for example, a ferroelectric liquid crystal mode and a antiferroelectric liquid crystal mode only capable of displaying two-tone images).

Another liquid crystal display device of the present invention includes a TFT substrate having thin film transistors arranged in a matrix, a counter substrate having a transparent electrode, a liquid crystal material interposed between the TFT substrate and the counter substrate, and a control section for applying a voltage that changes in a substantially continuous manner to a storage capacitor line during a period within one frame, thereby writing a drain voltage in a drain electrode during the one frame, wherein a response start time of the liquid crystal material is determined by a magnitude of the drain voltage, and a transmissivity of the liquid crystal display device is determined by a potential difference between a potential of the storage capacitor line and a potential of the drain electrode.

With such a liquid crystal display device, an analog gray scale property (capable of displaying images with a full gray scale) can be obtained even in a liquid crystal mode having a limited number of gray scales (for example, a ferroelectric liquid crystal mode and a antiferroelectric liquid crystal mode only capable of displaying two-tone images).

Still another liquid crystal display device of the present invention includes a main substrate having a main electrode, a counter substrate having a counter electrode, a liquid crystal material interposed between the main substrate and the counter substrate, and a control section for applying a voltage that changes in a substantially continuous manner to the liquid crystal material for a predetermined period within one frame, wherein a response start time of the liquid crystal material and a transmissivity of the liquid crystal display device are changed by changing an amplitude of the voltage.

With such a liquid crystal display device, an analog gray scale property (capable of displaying images with a full gray scale) can be obtained even in a liquid crystal mode having a limited number of gray scales (for example, a ferroelectric liquid crystal mode and a antiferroelectric liquid crystal mode only capable of displaying two-tone images).

Another liquid crystal display device of the present invention includes a TFT substrate having thin film transistors arranged in a matrix, a counter substrate having a transparent electrode, a liquid crystal material interposed between the TFT substrate and the counter substrate, an element having a resistance value that changes in accordance with a voltage applied to a memory capacitor of a pixel, and a control section for applying a voltage that changes in a substantially continuous manner to the element during a period within one frame, wherein the liquid crystal material is connected in series to the element, and a response start time of the liquid crystal material and a transmissivity of the liquid crystal display device are changed by changing an amplitude of the voltage that changes in a substantially continuous manner.

With such a liquid crystal display device, an analog gray scale property (capable of displaying images with a full gray scale) can be obtained even in a liquid crystal mode having a limited number of gray scales (for example, a ferroelectric liquid crystal mode and a antiferroelectric liquid crystal mode only capable of displaying two-tone images).

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A liquid crystal display device comprising:

a main substrate having a main electrode;

a counter substrate having a counter electrode;

a liquid crystal material interposed between the main substrate and the counter substrate; and a control section for controlling a response start time of the liquid crystal material by a potential difference between a main electrode voltage that is applied to the main electrode during one frame and a counter electrode voltage that changes in a substantially continuous manner during the one frame, and for changing a transmissivity of the liquid crystal display device based on a magnitude of the main electrode voltage.

2. A liquid crystal display device according to claim 1, wherein the control section changes the transmissivity of the liquid crystal display device by changing a direct-current voltage component of the main electrode voltage that is applied to the main electrode.

3. A liquid crystal display device according to claim 1, wherein the control section changes the transmissivity of the liquid crystal display device by changing a direct-current voltage component of the counter electrode voltage that is applied to the counter electrode.

4. A liquid crystal display device according to claim 1, wherein the control section changes the transmissivity of the liquid crystal display device by changing a slope angle of a waveform of the counter electrode voltage with respect to the passage of time.

5. A liquid crystal display device comprising:

a TFT substrate having thin film transistors arranged in a matrix;

a counter substrate having a transparent electrode;

a liquid crystal material interposed between the TFT substrate and the counter substrate; and a control section for applying a voltage that changes in a substantially continuous manner to a storage capacitor line during a period within one frame, thereby writing a drain voltage in a drain electrode during the one frame, wherein a response start time of the liquid crystal material is determined by a magnitude of the drain voltage, and a transmissivity of the liquid crystal display device is determined by a potential difference between a potential of the storage capacitor line and a potential of the drain electrode.

6. A liquid crystal display device according to claim 5, wherein the storage capacitor line is connected to a power supply which can be controlled independently of the power supply for applying the voltage to the counter substrate.

7. A liquid crystal display device according to claim 5, wherein:

an odd-numbered line storage capacitor line to be connected to pixels of odd-numbered lines is connected to a first power supply;

an even-numbered line storage capacitor line to be connected to pixels of even-numbered lines is connected to a second power supply; and the first power supply is different from the second power supply.

8. A liquid crystal display device according to claim 5, wherein the one frame includes a period during which a voltage for resetting an orientation of the liquid crystal material to the initial state is applied to the storage capacitor line.

9. A liquid crystal display device according to claim 5, wherein the control section applies the voltage for resetting the orientation of the liquid crystal material to the initial state to the liquid crystal material through a source line during the one frame.

10. A liquid crystal display device according to claim 1, wherein the one frame includes a period during which at least one of the voltage to be applied to the counter electrode and the voltage to be applied to the main electrode resets the orientation of the liquid crystal material to the initial state.

11. A liquid crystal display device according to claim 5, wherein, during the one frame, after a signal has been written in the thin film transistor element, the voltage that changes in a substantially continuous manner is applied to the storage capacitor line.

12. A liquid crystal display device according to claim 5, wherein the one frame includes a period during which a signal is written in the thin film transistor element, a period during which a voltage to be applied to the storage capacitor line changes in a substantially continuous manner, and a period during which the orientation of the liquid crystal material is reset to the initial state.

13. A liquid crystal display device comprising:

a main substrate having a main electrode;

a counter substrate having a counter electrode;

a liquid crystal material interposed between the main substrate and the counter substrate; and a control section for applying a voltage that changes in a substantially continuous manner to the liquid crystal material for a predetermined period within one frame, wherein a response start time of the liquid crystal material and a transmissivity of the liquid crystal display device are changed by changing an amplitude of the voltage.

14. A liquid crystal display device comprising:

a TFT substrate having thin film transistors arranged in a matrix;

a counter substrate having a transparent electrode;

a liquid crystal material interposed between the TFT substrate and the counter substrate;

an element having a resistance value that changes in accordance with a voltage applied to a memory capacitor of a pixel; and a control section for applying a voltage that changes in a substantially continuous manner to the element during a period within one frame, wherein the liquid crystal material is connected in series to the element, and a response start time of the liquid crystal material and a transmissivity of the liquid crystal display device are changed by changing an amplitude of the voltage that changes in a substantially continuous manner.

15. A liquid crystal display device according to claim 13, wherein:

the control section includes a first power supply for applying a voltage to the liquid crystal display material through an odd-numbered line and a second power supply for applying a voltage to the liquid crystal display material through an even-numbered line; and the first power supply is different from the second power supply.

16. A liquid crystal display device according to claim 13, wherein the one frame includes a period during which a voltage for resetting an orientation of the liquid crystal material to an initial state is applied to the liquid crystal material.

17. A liquid crystal display device according to claim 13, wherein the one frame includes a period during which a voltage for resetting an orientation of the liquid crystal material to an initial state is applied to the element.

18. A liquid crystal display device according to claim 14, wherein the one frame includes a period during which a voltage for resetting an orientation of the liquid crystal material to an initial state is applied to the element.

19. A liquid crystal display device according to claim 14, wherein the control section applies a voltage for resetting to an initial state an orientation of the liquid crystal material to the liquid crystal material through a source line.

20. A liquid crystal display device according to claim 14, wherein, during the one frame, after a signal has been written in the thin film transistor element, the voltage that changes in a substantially continuous manner is applied to the element.

21. A liquid crystal display device according to claim 14, wherein the one frame includes a first period during which a signal is written in the thin film transistor element, a second period during which a voltage to be applied to the element changes in a substantially continuous manner, and a third period during which the orientation of the liquid crystal material is reset to the initial state.

22. A liquid crystal display device according to claim 1, wherein the liquid crystal material is a ferroelectric liquid crystal material.

23. A liquid crystal display device according to claim 5, wherein the liquid crystal material is a ferroelectric liquid crystal material.

24. A liquid crystal display device according to claim 13, wherein the liquid crystal material is a ferroelectric liquid crystal material.

25. A liquid crystal display device according to claim 14, wherein the liquid crystal material is a ferroelectric liquid crystal material.

26. A liquid crystal display device according to claim 1, wherein the liquid crystal material is an antiferroelectric liquid crystal material.

27. A liquid crystal display device according to claim 5, wherein the liquid crystal material is an antiferroelectric liquid crystal material.

28. A liquid crystal display device according to claim 13, wherein the liquid crystal material is an antiferroelectric liquid crystal material.

29. A liquid crystal display device according to claim 14, wherein the liquid crystal material is an antiferroelectric liquid crystal material.

30. A liquid crystal display device according to claim 1, wherein the liquid crystal material has a liquid crystal mode including two or more stable states.

31. A liquid crystal display device according to claim 5, wherein the liquid crystal material has a liquid crystal mode including two or more stable states.

32. A liquid crystal display device according to claim 13, wherein the liquid crystal material has a liquid crystal mode including two or more stable states.

33. A liquid crystal display device according to claim 14, wherein the liquid crystal material has a liquid crystal mode including two or more stable states.

34. A liquid crystal display device according to claim 1, comprising a light source which is off for a predetermined period within the one frame.

35. A liquid crystal display device according to claim 5, comprising a light source which is off for a predetermined period within the one frame.

36. A liquid crystal display device according to claim 13, comprising a light source which is off for a predetermined period within the one frame.

37. A liquid crystal display device according to claim 14, comprising a light source which is off for a predetermined period within the one frame.

38. A liquid crystal display device according to claim 1, wherein:

the liquid crystal display device includes a red light source, a green light source, and a blue light source, and field serial color display is performed by sequentially switching from one to another among the light sources for each frame, whereby a single color image is obtained from a plurality of frames.

39. A liquid crystal display device according to claim 5, wherein:

the liquid crystal display device includes a red light source, a green light source, and a blue light source, and field serial color display is performed by sequentially switching from one to another among the light sources for each frame, whereby a single color image is obtained from a plurality of frames.

40. A liquid crystal display device according to claim 13, wherein:

the liquid crystal display device includes a red light source, a green light source, and a blue light source, and field serial color display is performed by sequentially switching from one to another among the light sources for each frame, whereby a single color image is obtained from a plurality of frames.

41. A liquid crystal display device according to claim 14, wherein:

the liquid crystal display device includes a red light source, a green light source, and a blue light source, and field serial color display is performed by sequentially switching from one to another among the light sources for each frame, whereby a single color image is obtained from a plurality of frames.

42. A liquid crystal display device according to claim 5, wherein the control section controls a waveform of a voltage to be applied to the storage capacitor line, thereby adjusting at least one gray scale property of the liquid crystal display device.

43. A liquid crystal display device according to claim 13, wherein the control section controls a waveform of a voltage to be applied to the liquid crystal material, thereby adjusting at least one gray scale property of the liquid crystal display device.

44. A liquid crystal display device according to claim 14, wherein the control section controls a waveform of a voltage to be applied to the element, thereby adjusting at least one gray scale property of the liquid crystal display device.

45. A liquid crystal display device according to claim 5, wherein the control section adjusts a source signal voltage to be written corresponding to a gray scale signal, thereby adjusting at least one gray scale property of the liquid crystal display device.

46. A liquid crystal display device according to claim 14, wherein the control section adjusts a source signal voltage that is to be written in the element and that corresponds to a gray scale signal, thereby adjusting at least one gray scale property of the liquid crystal display device.

* * * * *